US012465083B2

(12) United States Patent
Carfield et al.

(10) Patent No.: US 12,465,083 B2
(45) Date of Patent: Nov. 11, 2025

(54) RELEASABLE MOUTHPIECE LOCKING MECHANISM

(71) Applicant: Hanna Carfield, Sunnyvale, CA (US)

(72) Inventors: Hanna Carfield, Sunnyvale, CA (US); Wentao Yang, Shenzhen (CN)

(73) Assignee: Hanna Carfield, Sunnyvale, CA (US)

( * ) Notice: Subject to any disclaimer, the term of this patent is extended or adjusted under 35 U.S.C. 154(b) by 0 days.

(21) Appl. No.: 18/020,558

(22) PCT Filed: Oct. 14, 2022

(86) PCT No.: PCT/US2022/078109

§ 371 (c)(1),
(2) Date: Feb. 9, 2023

(87) PCT Pub. No.: WO2023/064896

PCT Pub. Date: Apr. 20, 2023

(65) Prior Publication Data

US 2024/0298702 A1 Sep. 12, 2024

Related U.S. Application Data

(60) Provisional application No. 63/325,839, filed on Mar. 31, 2022, provisional application No. 63/282,366, filed on Nov. 23, 2021, provisional application No. 63/255,890, filed on Oct. 14, 2021.

(51) Int. Cl.

| | |
|---|---|
| ***A24F 47/00*** | (2020.01) |
| ***A24F 7/00*** | (2006.01) |
| ***A24F 40/42*** | (2020.01) |

(52) U.S. Cl.
CPC ..... *A24F 40/42* (2020.01); *A24F 7/00* (2013.01)

(58) Field of Classification Search
CPC ..... A24F 40/40; A24F 40/42; A24F 40/70
See application file for complete search history.

(56) References Cited

U.S. PATENT DOCUMENTS

| | | | | |
|---|---|---|---|---|
| 11,116,251 | B1 | 9/2021 | Aksenov et al. | |
| 2018/0103684 | A1* | 4/2018 | Liu | A24F 7/02 |
| 2020/0315258 | A1 | 10/2020 | Yuan | |
| 2022/0175029 | A1 | 6/2022 | Michaud | |

FOREIGN PATENT DOCUMENTS

| | | | |
|---|---|---|---|
| WO | 2019218897 | A1 | 11/2019 |

* cited by examiner

*Primary Examiner* — Eric Yaary
(74) *Attorney, Agent, or Firm* — Gregory P. Einhorn; Greer, Burns & Crain, Ltd.

(57) ABSTRACT

A releasable mouthpiece locking mechanism comprises one or more pairs of flexible, hooked arms that can be disposed in an interior portion of a mouthpiece housing. The arms can engage a tube of a vaporization cartridge to lock the vaporization cartridge and can be radially displaced to release the vaporization cartridge.

12 Claims, 18 Drawing Sheets

RELEASABLE MOUTHPIECE LOCKING MECHANISM

RELATED APPLICATIONS

This U.S. National Phase Application claims benefit of priority to Patent Convention Treaty (PCT) International Application PCT/US2022/078109, filed Oct. 14, 2022, now pending, which claims the benefit of priority under 35 U.S.C. § 119(e) of U.S. Provisional Application Ser. No. 63/255,890, filed Oct. 14, 2021; U.S. Ser. No. 63/282,366, filed Nov. 23, 2021; and U.S. Ser. No. 63/325,839, filed Mar. 31, 2022. The aforementioned applications are expressly incorporated herein by reference in their entirety and for all purposes. All publications, patents, patent applications cited herein are hereby expressly incorporated by reference for all purposes.

TECHNICAL FIELD

The present invention relates to personal vaporization devices. Example embodiments relate more particularly to apparatuses and methods for releasably locking a mouthpiece to a vaporization cartridge

BACKGROUND

Personal vaporization devices, also known as vaporizers or vapes or atomizers, amongst other names, have grown substantially in popularity over the last several years. Such devices typically include a cartridge having an internal reservoir that holds a vaporization liquid, commonly called an e-liquid or plant-based oil extract, that is vaporized for inhalation by a user. Such e-liquids or plant-based oil extracts often contain, for example without limitation, nicotine or cannabis extracts. An issue that has therefore arisen with the popularity of such devices is keeping the e-liquids out of the reach of children. Accordingly, such devices often have a child-proof structure having components including, for example without limitation, a mouthpiece and a cartridge, that once assembled together are permanently connected so as to seal the e-liquid contents from being undesirably accessed.

All current mouthpiece locking mechanisms are permanently connected. A drawback to this permanently connected mouthpiece locking mechanism is that the mouthpiece connection cannot be unlocked so that the cartridge reservoir cannot be accessed without damaging or breaking the device, which effectively prevents re-filling of the reservoir. Another drawback to a permanently connected mouthpiece locking mechanism is that the e-liquid within the reservoir cannot be accessed for legitimate non-vaping purposes, for example, for testing. This makes it difficult for testing labs to access the e-liquid, for example, for heavy metals testing. In order to access the e-liquid, the mouthpiece needs to be broken or cut off with tools. During such a destructive removal process, the e-liquid can get contaminated with debris from the cartridge possibly including heavy metals, thereby causing a failed test result.

A need therefore exists for a mouthpiece locking mechanism that can be released. Such a releasable mouthpiece locking mechanism will prevent potential test failures caused by contamination during destructive removal of the mouthpiece. Such a releasable mouthpiece locking mechanism is further beneficial because it can prevent access to the e-liquid while also allowing the mouthpiece to be removed, for example, to save the cartridge contents, e-liquid or plant-based oil extracts in the case of malfunction. It would be beneficial for efficient manufacturing if such a releasable mouthpiece locking mechanism could allow for low torque capping along with mass capping capabilities. It would be further beneficial if the releasable mouthpiece locking mechanism is child-resistant to ensure safety. It would be still further beneficial if the locking mechanism could be released by a simple release mechanism.

SUMMARY

In one aspect, a releasable locking mouthpiece comprises two or more doubly hooked arms disposed on an interior portion of a mouthpiece for a vaporizer. The doubly hooked arms may provide a releasable locking mechanism between the mouthpiece and a cartridge of the vaporizer. In example embodiments, the releasable mouthpiece locking mechanism may be released by insertion of a release pin through the mouthpiece into the vaporizer.

In another aspect, a mouthpiece assembly comprises a locking adapter for sealing a cartridge reservoir of a vaporization cartridge. The locking adapter may accept one or more interchangeable mouthpiece housings via friction fit or press fit. In example embodiments, the locking adapter is releasable from the vaporization cartridge via a radially compressive force applied to depress a pair of release arms on the locking adapter with or without removal of an interchangeable mouthpiece.

DESCRIPTION OF DRAWINGS

The drawings set forth herein are illustrative of exemplary embodiments provided herein and are not meant to limit the scope of the invention as encompassed by the claims.

Figures are described in detail herein.

Like reference symbols in the various drawings indicate like elements.

DETAILED DESCRIPTION

The following detailed embodiments presented herein are for illustrative purposes. That is, these detailed embodiments are intended to be exemplary of the present invention for the purposes of providing and aiding a person skilled in the pertinent art to readily understand how to make and use of the present invention. While certain shapes and materials are used in some embodiments, they are by no means an intention of restriction. Specific materials for embodiments are, for example without limitation, Brass, Stainless Steel, Copper, Lead-Free Copper, Zirconia Ceramic, Poly Cyclohexylenedimethylene Terephthalate Glycol (PCTG), Polyamide Nylon (PA), Polypropylene (PP), and other various plastics.

According to example embodiments herein, a mouthpiece 100 including a releasable locking mouthpiece mechanism is provided for a vaporizer. The example mechanism locks to provide a child-proof closure preventing access to internal e-liquid disposed within the vaporizer. The example mechanism further includes a release mechanism in the form of a pin inserted into the vaporizer through the mouthpiece. The releasable mouthpiece locking mechanism can be manufactured in industry for use in products for consumers.

Figure 1:
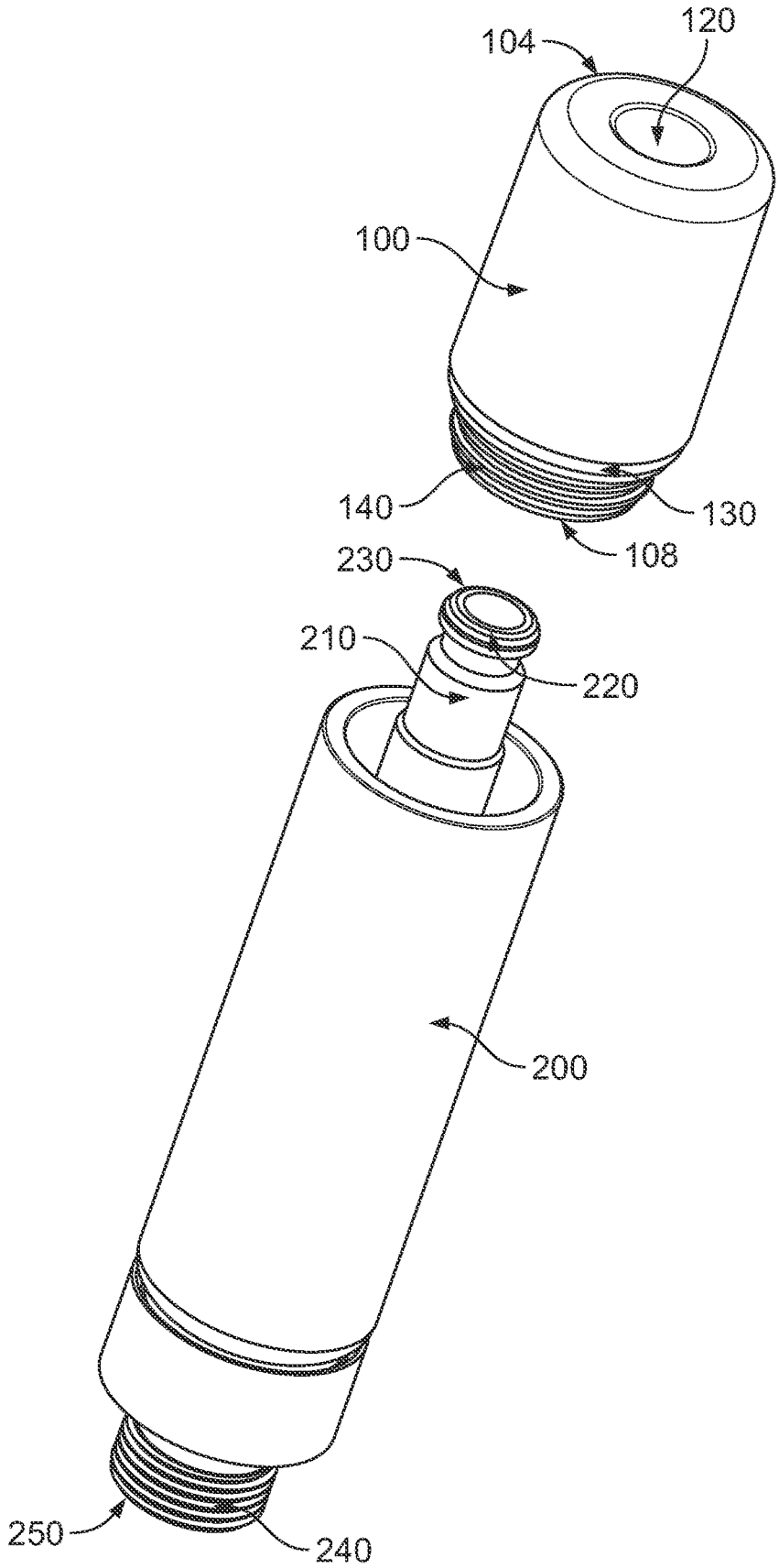
FIG. 1 is an exploded view of an exemplary mouthpiece and an exemplary vaporization cartridge according to an embodiment of the invention.

Exemplary embodiments of the mouthpiece 100 and an exemplary vaporization cartridge (cartridge) 200 are illustrated in FIG. 1. The exemplary mouthpiece 100 includes a passage 110 (see FIG. 2) disposed therethrough having a hole 120 disposed at a first end 104 of the mouthpiece 100. A support structure 130 supporting a sealing cap ring 140 thereon defines a second end 108 of the mouthpiece 100 opposite the hole 120.

Still referring to FIG. 1, the exemplary vaporization cartridge 200 includes a tube 210 having a radially outwardly extending shoulder 220 disposed circumferentially around a first end 230 of the tube 210 (and of the vaporization cartridge 200). The exemplary vaporization cartridge 200 further includes a connection 240, for example without limitation, a threaded connection 240 disposed at a second end 250 of the cartridge 200. The connection 240 allows the cartridge 200 to connect to a source of power, for example a battery component (not shown) having a complementary connector, to provide power to a heating unit 260 disposed with the cartridge 200.

Figure 2:
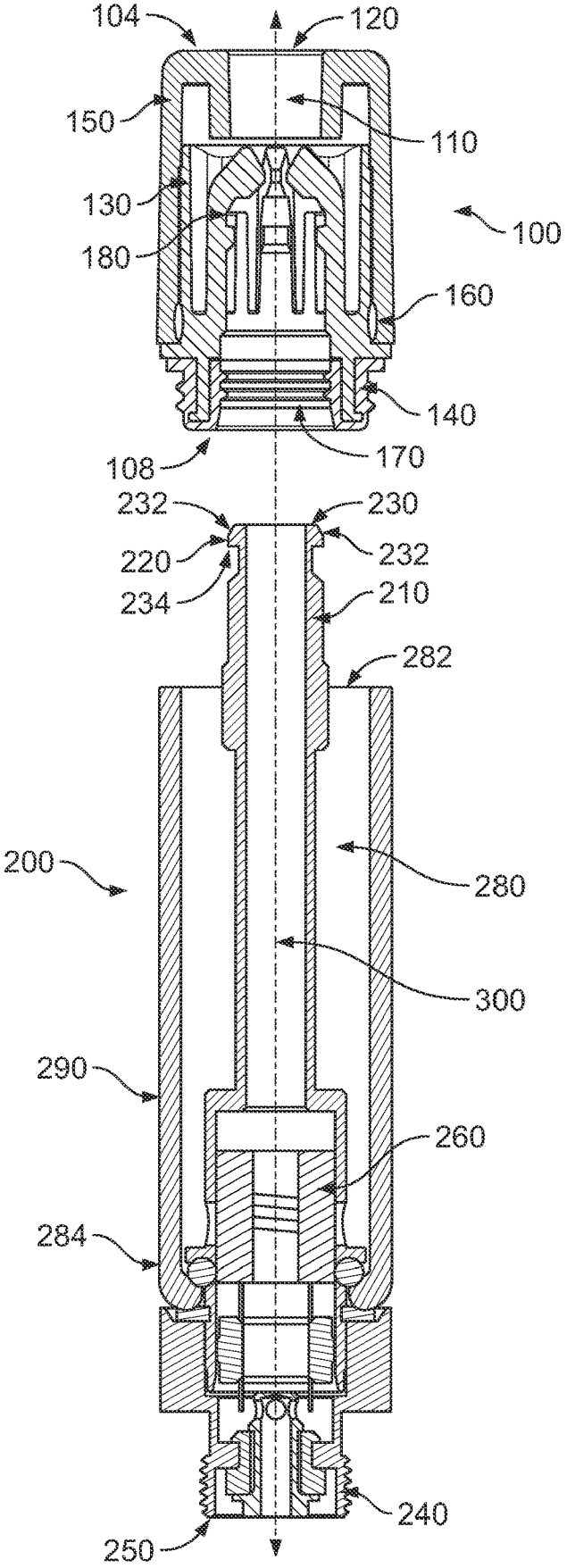
FIG. 2 is a cross-sectional view of the exploded view of FIG. 1.

A cross-sectional view of the exemplary mouthpiece 100 and the exemplary vaporization cartridge 200 are shown in FIG. 2 aligned along a common longitudinal axis 300. The exemplary mouthpiece 100 in an embodiment includes a mouthpiece housing 150 into which is fixedly, e.g., permanently, attached the support structure 130 supporting the sealing cap ring 140 thereon. FIG. 2 illustrates an embodiment including a pool of adhesive 160 permanently attaching the support structure 130 within the mouthpiece housing 150; however, in other embodiments the support structure 130 is attached fixedly (e.g., permanently) within the mouthpiece housing 150 by any sort of connection as is known in the art including, for example without limitation, a snap fit, an ultrasonic weld, an adhesive, or the like. In other embodiments the support structure 130 is not a separate component that is fixedly or permanently attached to the mouthpiece housing 150, but rather is manufactured integrally with the mouthpiece housing 150.

Referring to FIG. 2, the support structure 130 has a passage 170 aligned with and in fluid communication with the passage 110 disposed along the longitudinal axis 300 through the mouthpiece housing 150. The support structure 130 has a first end and a second end oriented as with the first end 104 and the second end 108 of the mouthpiece.

Figure 4:
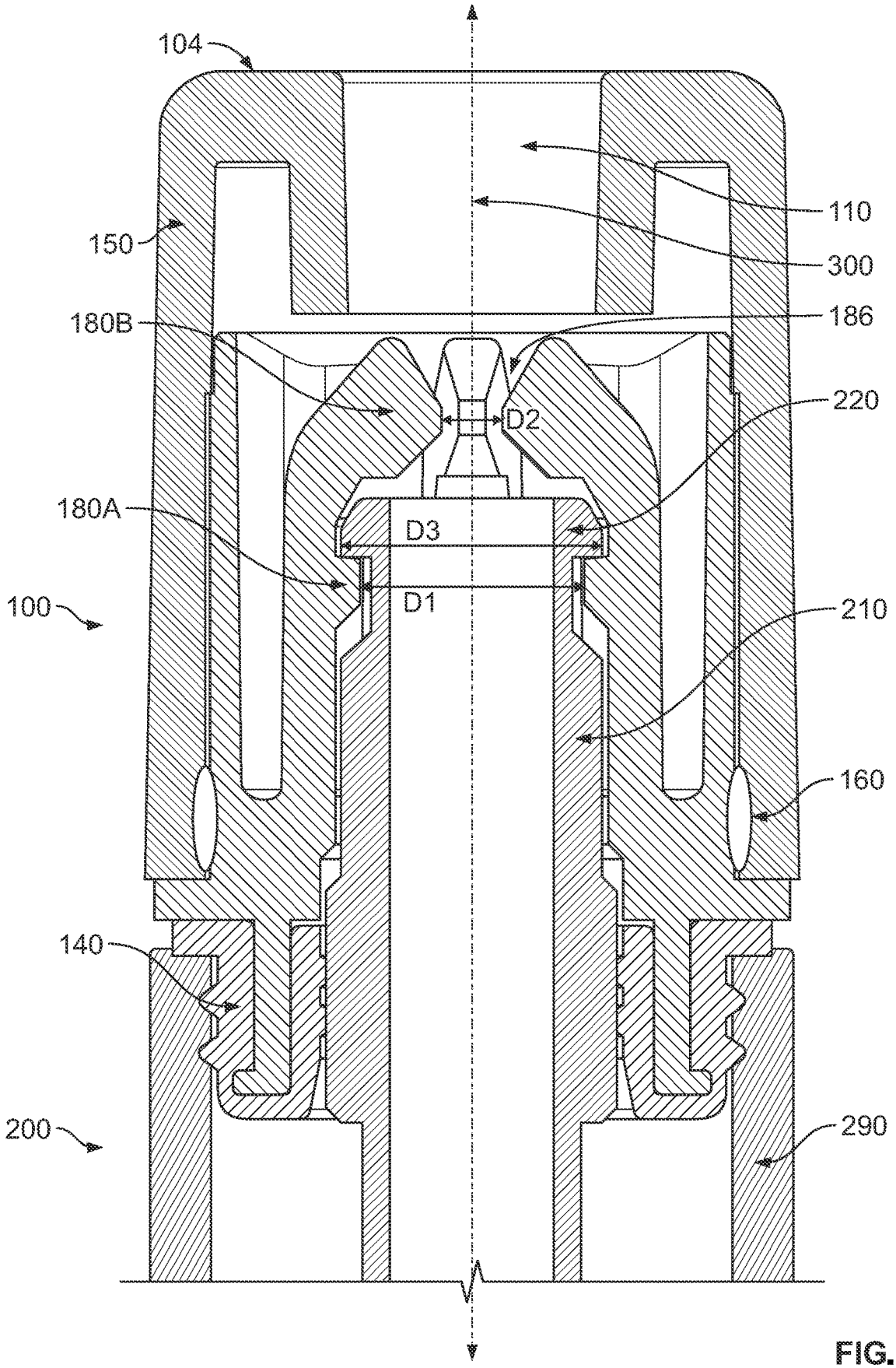
FIG. 4 is an enlarged cross-sectional view of the exemplary mouthpiece of FIG. 1 assembled with the vaporization cartridge of FIG. 1.
Figure 5:
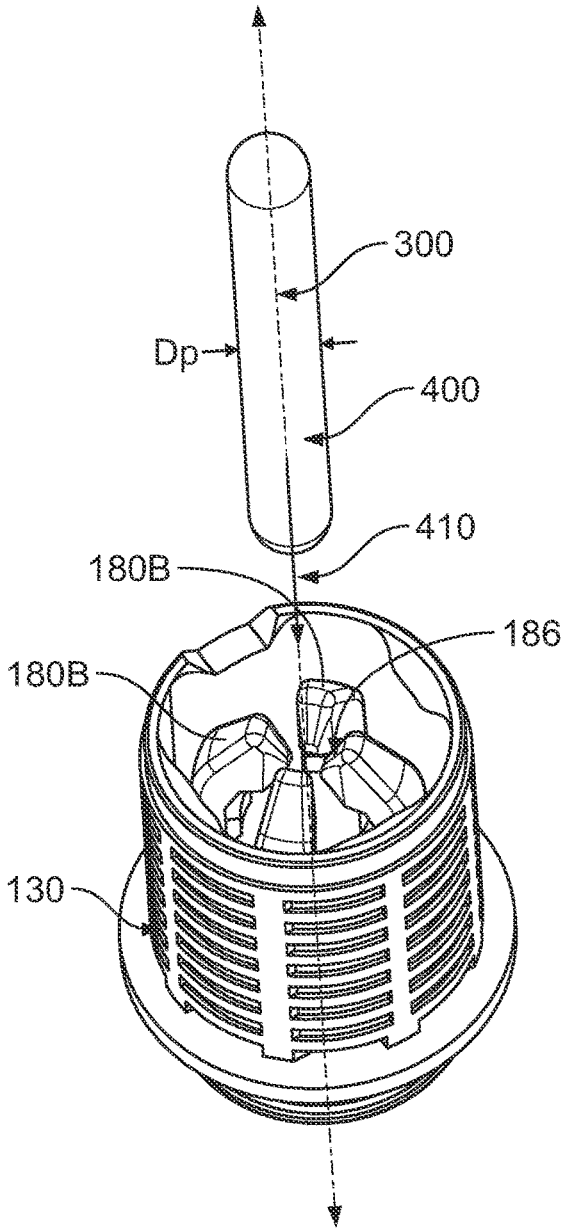
FIG. 5 is a schematic view of second hooked portions as they appear in an assembled state before introduction of a release pin.
Figure 6:
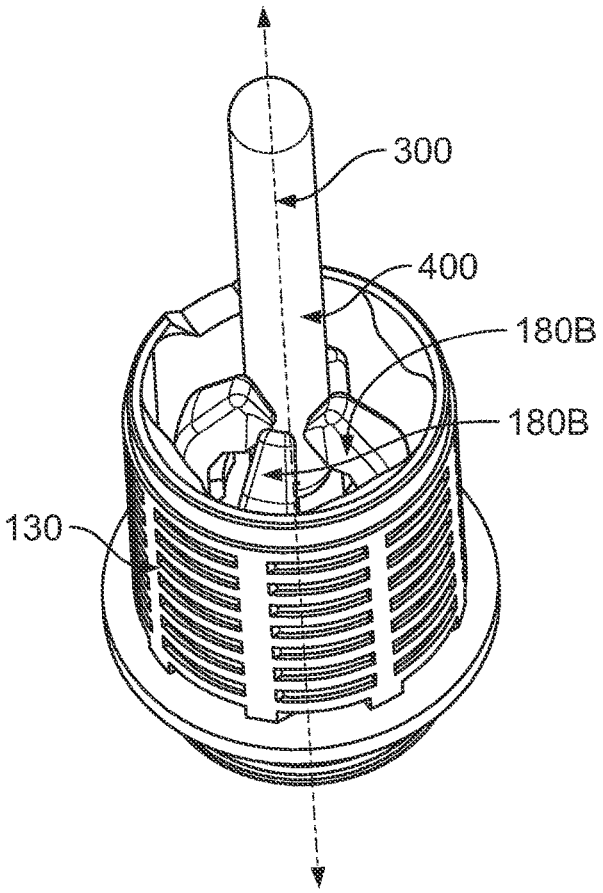
FIG. 6 is a schematic view of the second hooked portions as they appear in a released state during introduction of the release pin.

Two or more doubly hooked arms 180, an opposing pair of such doubly hooked arms being visible in FIG. 2 and two such opposing pairs (four arms total) being visible in FIGS. 5 and 6, extend longitudinally from the support structure 130 toward the first end of the support structure and toward the passage 110. The two or more doubly hooked arms 180 each includes two differently sized hooked portions, a first hooked portion 180A and a second hooked portion 180B (illustrated more clearly in FIGS. 3-6). Each of the first and second hooked portions 180A and 180B includes a structure that extends radially inwardly toward the longitudinal axis 300.

Referring again to FIG. 2, the cartridge 200 includes the tube 210 having the radially outwardly extending shoulder 220 disposed circumferentially around an end of the tube 210 disposed at a first end 230 of the cartridge 200. In an embodiment the shoulder 220 includes a first side facing toward the first end 230, the first side having a surface 232 that is angled relative to the longitudinal axis 300 of the cartridge 200. In an embodiment, the shoulder 220 further includes a second side facing away from the first end 230, the second side having a surface 234 that is perpendicular to the longitudinal axis 300 of the cartridge 200.

A fluid reservoir 280 is defined by an outer wall 290 to be disposed annularly around the tube 210. The fluid reservoir 280 is open at a first end 282 and includes a portion that extends longitudinally toward a second end 284 that is in fluid communication with an exterior surface of the heating unit 260.

Figure 3:
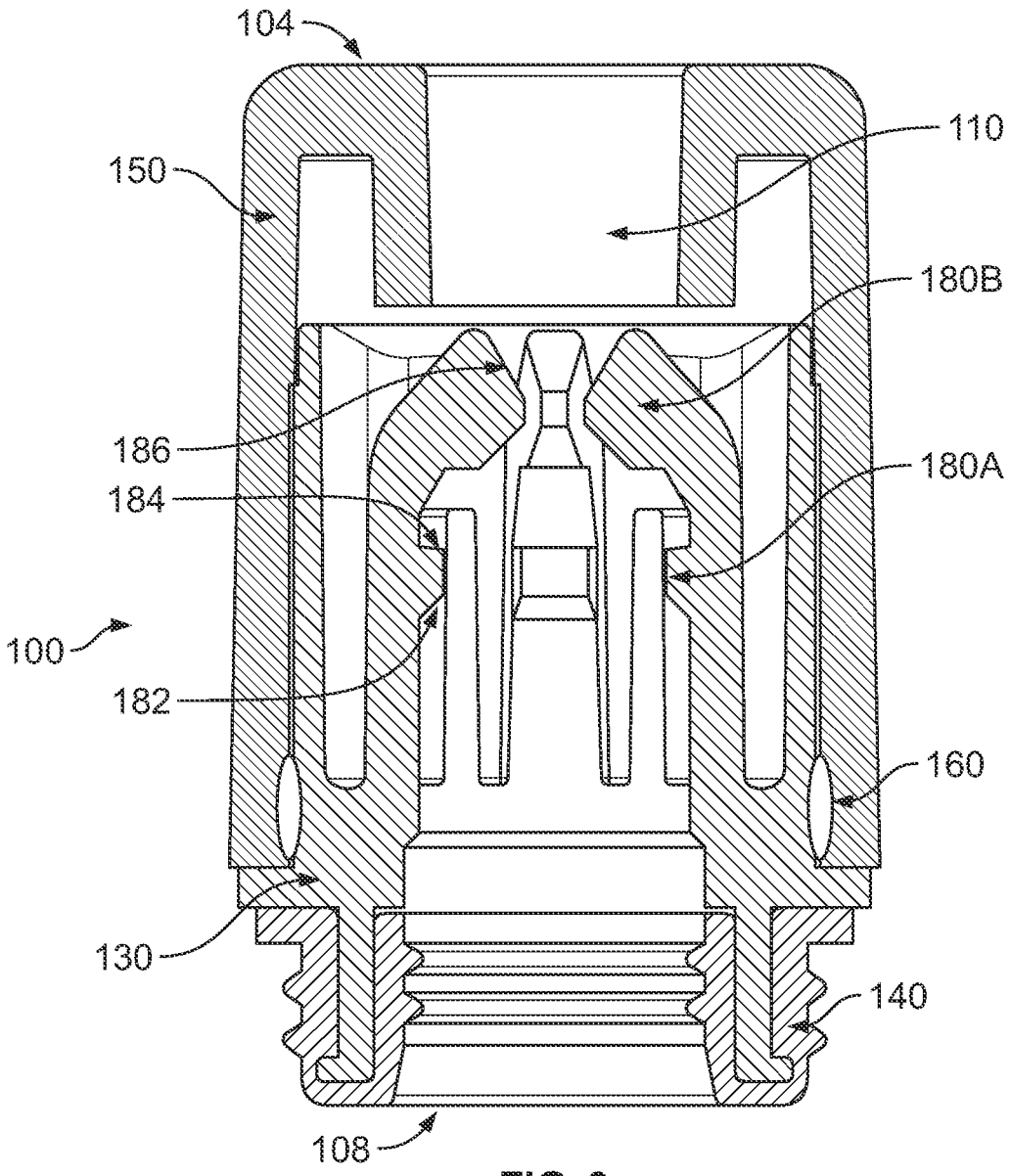
FIG. 3 is an enlarged cross-sectional view of the exemplary mouthpiece of FIG. 1.

Referring now to FIG. 3, features of the first and second hooked portions 180A and 180B of the two or more doubly hooked arms 180 are illustrated. In an embodiment each of the first hooked portions 180A includes a first side facing toward the second end 108 of the mouthpiece 100, the first side having a surface 182 that is angled relative to the longitudinal axis 300 of the mouthpiece 100. In an embodiment each of the first hooked portions 180A further includes a second side facing away from the second end 108 of the mouthpiece 100, the second side having a surface 184 that is perpendicular to the longitudinal axis 300 of the mouthpiece 100. In an embodiment each of the second hooked portions 180B includes a first side facing toward the first end 104 of the mouthpiece 100, the first side having a surface 186 that is angled relative to the longitudinal axis 300 of the mouthpiece 100.

FIG. 4 illustrates the mouthpiece 100 and the cartridge 200 in an assembled state, wherein the shoulder 220 is disposed between the first and second hooked portions 180A and 180B. Further in the assembled state the sealing cap ring 140 is disposed in sealing contact with an interior surface of the outer wall 290 of the cartridge 200.

Referring to FIGS. 2-4, during assembly of the mouthpiece 100 onto the cartridge 200, force is applied to the mouthpiece 100 along the longitudinal axis (longitudinal centerline) 300 so that the surface 182 on each of the two or more first hooked portions 180A makes contact with the surface 232 on the shoulder 220. The surface 182 is tapered away from the cartridge 200 and toward the longitudinal axis 300, and the surface 232 has a complementary taper that is directed away from the mouthpiece 100 and away from the longitudinal axis 300. Application of force to push the mouthpiece 100 and the cartridge 200 together causes the two or more first hooked portions 180A to slide over the surface 232 and flex radially away from the longitudinal centerline 300. With continued application of force to the mouthpiece 100 the two or more first hooked portions 180A snap over the shoulder 220 so that the surface 184 on each of the two or more first hooked portions 180A is in contact with the surface 234 on the shoulder 220.

In this assembled state, as illustrated in FIG. 4, the mouthpiece 100 is locked onto the cartridge 200 because the surfaces 184 and 234 are parallel and in contact. Such a locking mouthpiece is child-proof because force applied to the mouthpiece 100 to separate it from the cartridge 200 cannot remove the mouthpiece 100 without breaking at least one of the shoulder 220 and the two or more first hooked portions 180A, and a child would not typically have the strength to apply sufficient force to break one of the components. However, as further described hereinbelow, the locking mouthpiece mechanism comprising the mouthpiece 100 and the cartridge 200 is releasable by a simple release mechanism.

FIGS. 5 and 6 illustrate such an exemplary release mechanism in the form of a release pin (pin) 400 applied to the doubly hooked arms 180. FIGS. 5 and 6 illustrate the support structure 130 without the surrounding mouthpiece housing 150 for clarity. The two or more second hooked portions 180B are shown in FIG. 5 disposed in a position that corresponds to the assembled state as illustrated in FIG. 4. To further assist with the description of the release mechanism, some exemplary distances are now defined and shown on FIGS. 4 and 5.

The distance between two opposing first hooked portions 180A is defined as D1. The distance between two opposing second hooked portions 180B is defined as D2. The distance between radially outer surfaces of the shoulder 220 is defined as D3. The exemplary pin 400 having any cross-sectional shape as desired has a minimum cross-sectional dimension Dp. For simplicity, all of the defined distances will be described for a circular geometry so that the distances are diameters, however for non-circular geometries, the distances can be minimum distances as appropriate for the mechanism to function as will be described.

Referring again to FIGS. 4 and 5, the diameter Dp of the pin 400 is larger than the distance D2. To achieve release of the mouthpiece 100, the pin 400 is pushed through the passages 110 and 170 in the direction of the arrow 410 and into contact with the surfaces 186, which are angled along the direction of motion of the pin 400 (which is along the longitudinal centerline 300) as described hereinabove and as visible, for example, in FIGS. 5 and 6. Further application of force to the pin 400 against the surfaces 186 causes the pin 400 to slide longitudinally along over the surfaces 186 thereby pushing the second hooked portions 180B apart and away from the longitudinal centerline 300. Because of the connection of the second hooked portions 180B to the first hooked portions 180A, displacement of the second hooked portions 180B away from the longitudinal centerline 300 causes displacement of the first hooked portions 180A away from the longitudinal centerline 300.

Referring now to FIG. 6, the pin 400 has now been pushed sufficiently far through the passage 110 of the mouthpiece 100 to be disposed between the second hooked portions 180B, which are visibly displaced radially away from the longitudinal centerline 300. In the state shown in FIG. 6, so long as the second hooked portions 180B have been displaced away from the longitudinal centerline 300 sufficiently to cause the first hooked portions 180 to also displace away from the longitudinal centerline 300 to a separation distance D1 that is greater than the distance D3, the mouthpiece 100 will release from the cartridge 200. The actual distance that the second hooked portions 180B must be separated by, and thus the actual required diameter of the pin 400, is dependent upon several factors, including for example without limitation, the flexibility and thicknesses of the first and second hooked portions 180A and 180B of the two or more doubly hooked arms 180, and may be adjusted in accordance with the requirements of, for example without limitation, locking tolerances and force required for breakage, or other considerations.

In an embodiment, the support structure 130 including the doubly hooked arms 180 is made, for example without limitation, by plastic injection via an injection molding process. In an embodiment, the support structure 130 including the doubly hooked arms 180 is made from a plastic, for example without limitation, Poly Cyclohexylenedimethylene Terephthalate Glycol (PCTG), Polyamide Nylon (PA), Polypropylene (PP), and other various plastic as known in the art.

For example, a molded support structure 130 made by such a process may be made by injecting liquid phase or molten material, for example without limitation, a plastic selected from the types of plastic listed above, into a mold, allowing the liquid phase or molten material to solidify and/or cool, and then removing the resultant molded support structure 130 from the mold. Examples of such injection molding processes are well known.

However, because the geometry of the releasable mouthpiece locking mechanism described above includes a physical barrier against axial motion along both directions of a longitudinal axis through the locking mechanism, a further release mechanism may be useful to remove a completed molded part from a mold. For instance, given the geometry of the support structure 130, and particularly the geometry of the doubly hooked arms 180 as shown above in cross-section in FIG. 4, any process for making the support structure 130 by injection of liquid phase or molten material into a mold would result in the doubly hooked arms 180 being locked into the mold. This is because the space between the first and second hooked portions 180A, 180B would necessarily be formed in a molding process by a radially outwardly directed portion of the mold. Consequently, upon solidification of the liquid phase or molten material, the resultant molded support structure 130 would be locked to the mold by the radially outwardly directed portion of the mold in much the same way that the mouthpiece 100 is locked to the cartridge 200 by the radially outwardly extending shoulder 220 as shown in FIG. 4.

Figure 7:
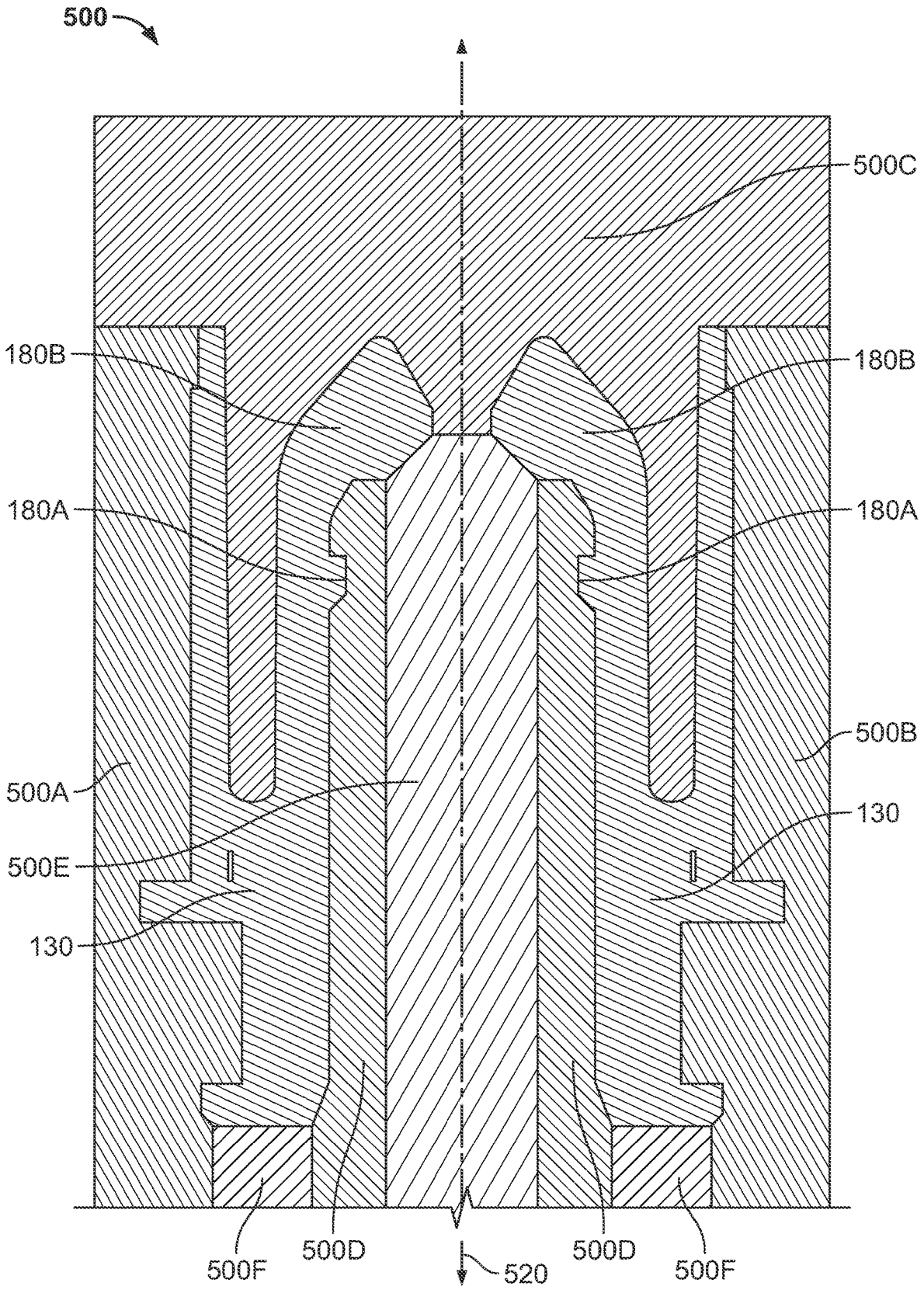
FIG. 7 is a cross-sectional schematic view of an assembled exemplary mold apparatus, wherein an empty space representative of a support structure to be molded, such as for the exemplary mouthpiece of FIG. 1, can be seen within.
Figure 8:
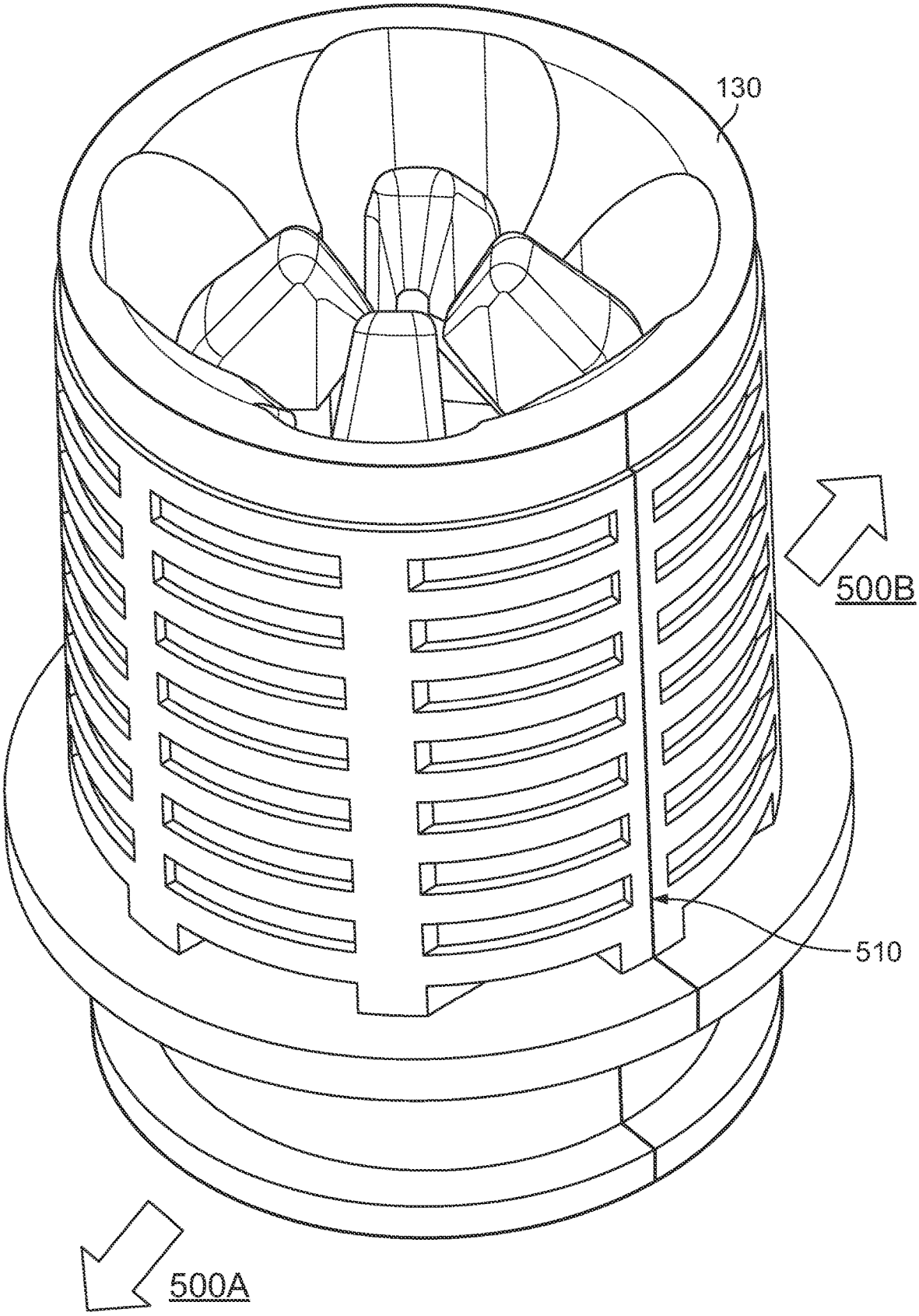
FIG. 8 is a perspective view of an embodiment of a support structure such as for the exemplary mouthpiece of FIG. 1 showing the outer peripheral surface of the support structure in relation to exemplary first and second side portions of the mold apparatus of FIG. 7 defining the outer peripheral surface.

Referring now to FIGS. 7 and 8, an apparatus and method for making the support structure 130 as a molded component having the doubly hooked arms 180 (comprising the first hooked portions 180A and the second hooked portions 180B) that includes a simple mechanism for release for the doubly hooked arms 180 is described. FIG. 7 illustrates a cross-sectional schematic view of an assembled exemplary mold apparatus 500, wherein an empty space representative of the support structure 130 can be seen within. In an embodiment the mold apparatus 500 includes six main components, which are labeled in FIG. 7 as 500A, 500B, 500C, 500D, 500E, and 500F. FIG. 8 illustrates a perspective view of the (molded) support structure 130 including an indication of where first and second side portions 500A and 500B of the mold apparatus 500 are positioned relative to the support structure 130.

Referring to FIGS. 7 and 8, the outer peripheral surface of the support structure 130 is defined by first and second side portions 500A and 500B that split vertically along an exemplary slide line 510 as indicated by the arrows labeled as 500A and 500B in FIG. 8. In an embodiment, a top portion 500C of the mold apparatus 500 is a single component. However, as will be discussed hereinbelow, due in part to the placement of injectors, the top portion 500C can be two or more components.

Referring to FIG. 7, in an embodiment a central mold portion 500D defines an inner surface of the support structure 130. The central mold portion 500D is alternatively referred to as the mold core 500D. In an embodiment an ejector pin 500E is disposed along a longitudinal centerline 520 of the mold apparatus 500. In an embodiment a knockout plate 500F is disposed around a base end of the mold core 500D disposed radially between the mold core 500D and the first and second side portions 500A and 500B.

Referring again to FIG. 7, with the mold apparatus 500 assembled as shown the process of material injection can proceed. The component parts of the mold apparatus 500 in an embodiment are held together by external compression from the top and sides.

In other embodiments the components of the mold apparatus 500 can snap together or otherwise mesh together and have external clamps or straps, for example, over-center clamps that once snapped shut do not open unless forced back by human intervention. The components of the mold apparatus 500 can be held together by other means as are known for multiple component molds as is known in the art.

Figure 9:
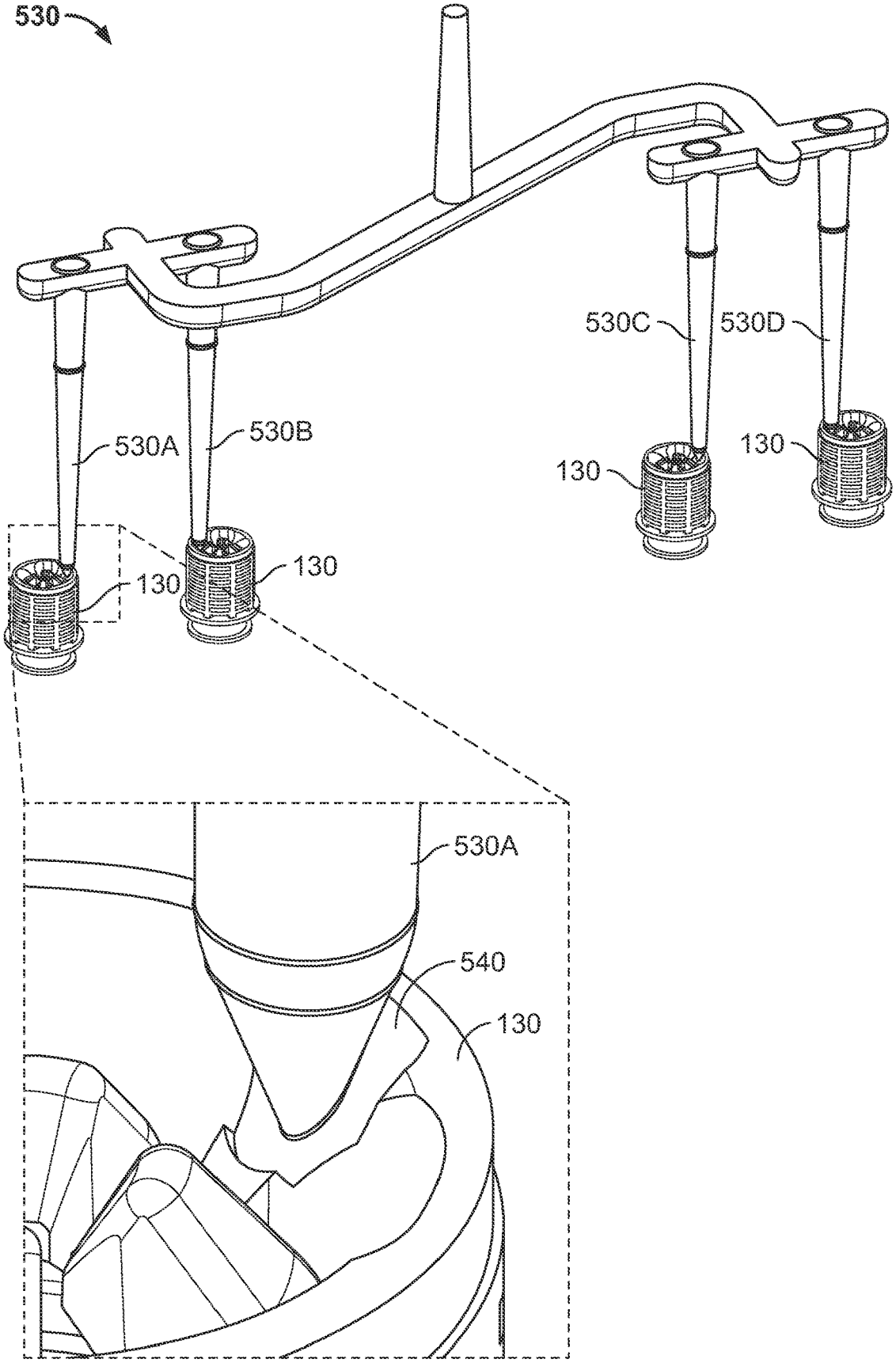
FIG. 9 is a schematic representation of an exemplary embodiment of one or more injection ports that inject liquid phase or molten material into the exemplary mold apparatus at one or more locations within the exemplary mold apparatus of FIG. 7.

FIG. 9 illustrates a schematic representation of an embodiment of one or more injection ports 530 that inject liquid phase or molten material 540 into the mold apparatus 500 at one or more locations within the mold apparatus 500. FIG. 9 shows the molded support structure 130 rather than the mold apparatus 500 for clarity of presentation. It is intended to show that in an embodiment, liquid phase or molten material is injected into the assembled mold apparatus 500 to produce the support structure 130 through the one or more injection ports 530, for example without limitation, through a plurality of injection ports 530A, 530B, 530C, and 530D as shown schematically in FIG. 9, where each of the one or more injection ports 530A, 530B, 530C, and 530D can inject liquid phase or molten material 540 into one or more injection points of the mold apparatus 500. In another embodiment, the one or more injection ports 530 is a single injection port 530 that is translated to a plurality of injection points within the mold apparatus 500, for example without limitation, by rotation of the top portion 500C relative to the rest of the mold apparatus 500 or by the opening and closing of one or more valves (not shown) within the top portion 500C to guide the liquid or molten material to the intended injection point (or to multiple intended injection points).

Figure 10:
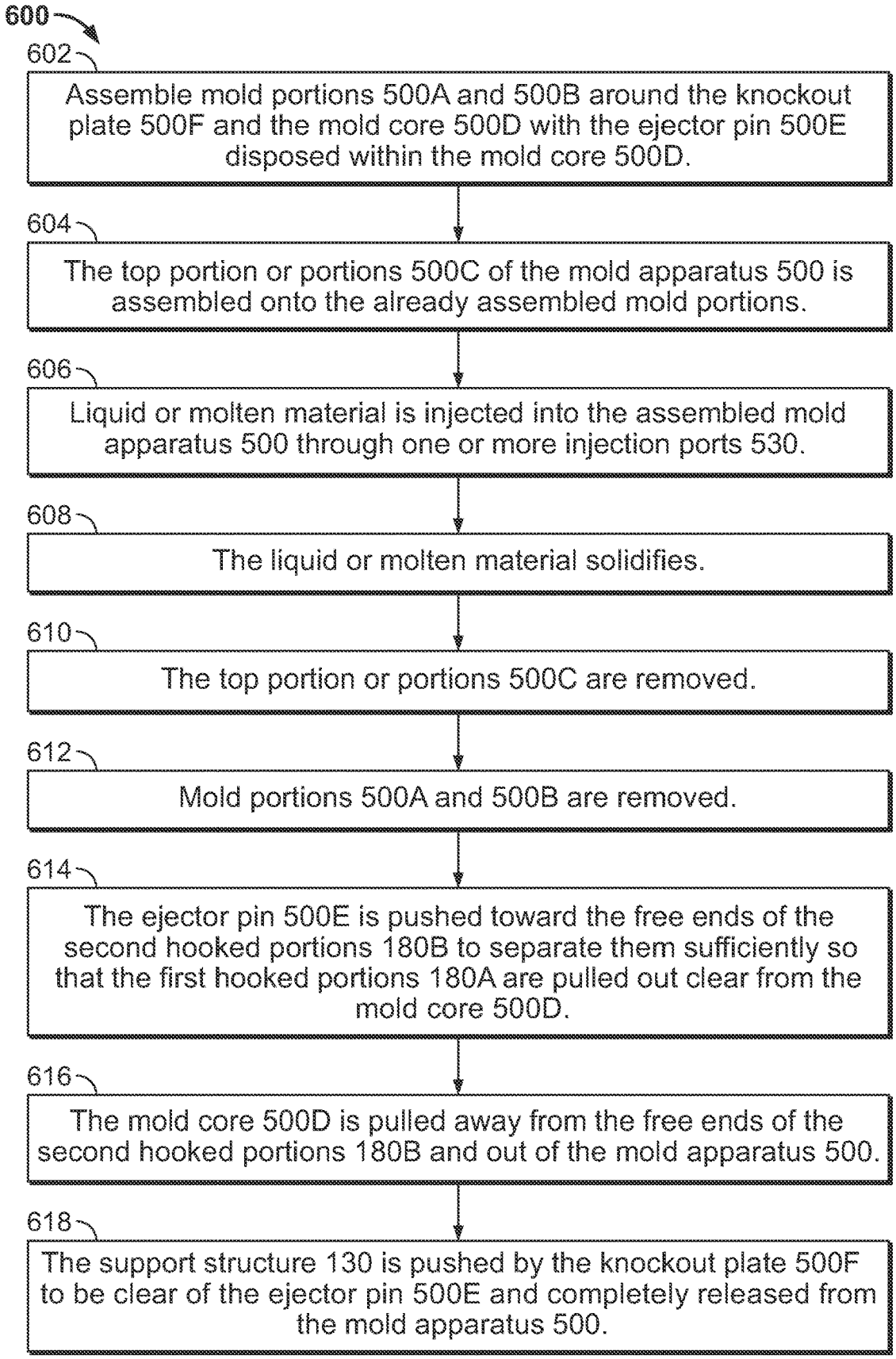
FIG. 10 is a flowchart of an embodiment of exemplary method steps for using the exemplary mold apparatus to produce the exemplary support structure.

Having described the structure and function for all the components of the mold apparatus 500 hereinabove, an exemplary method 600 of using the mold apparatus 500 to produce the support structure 130 will now be described. Referring to FIG. 10, at step 602, first and second side portions 500A and 500B are assembled around the knockout plate 500F and the mold core 500D with the ejector pin 500E disposed within the mold core 500D. At step 604, the top portion or portions 500C of the mold apparatus 500 is assembled onto the already assembled mold portions. At step 606, liquid or molten material is injected into the assembled mold apparatus 500 through the one or more injection ports 530 that are disposed through the top portion or portions 500C. At step 608 the liquid or molten material solidifies. At step 610, the top portion or portions 500C are removed. At step 612 the first and second side portions 500A and 500B are removed.

Figure 11:
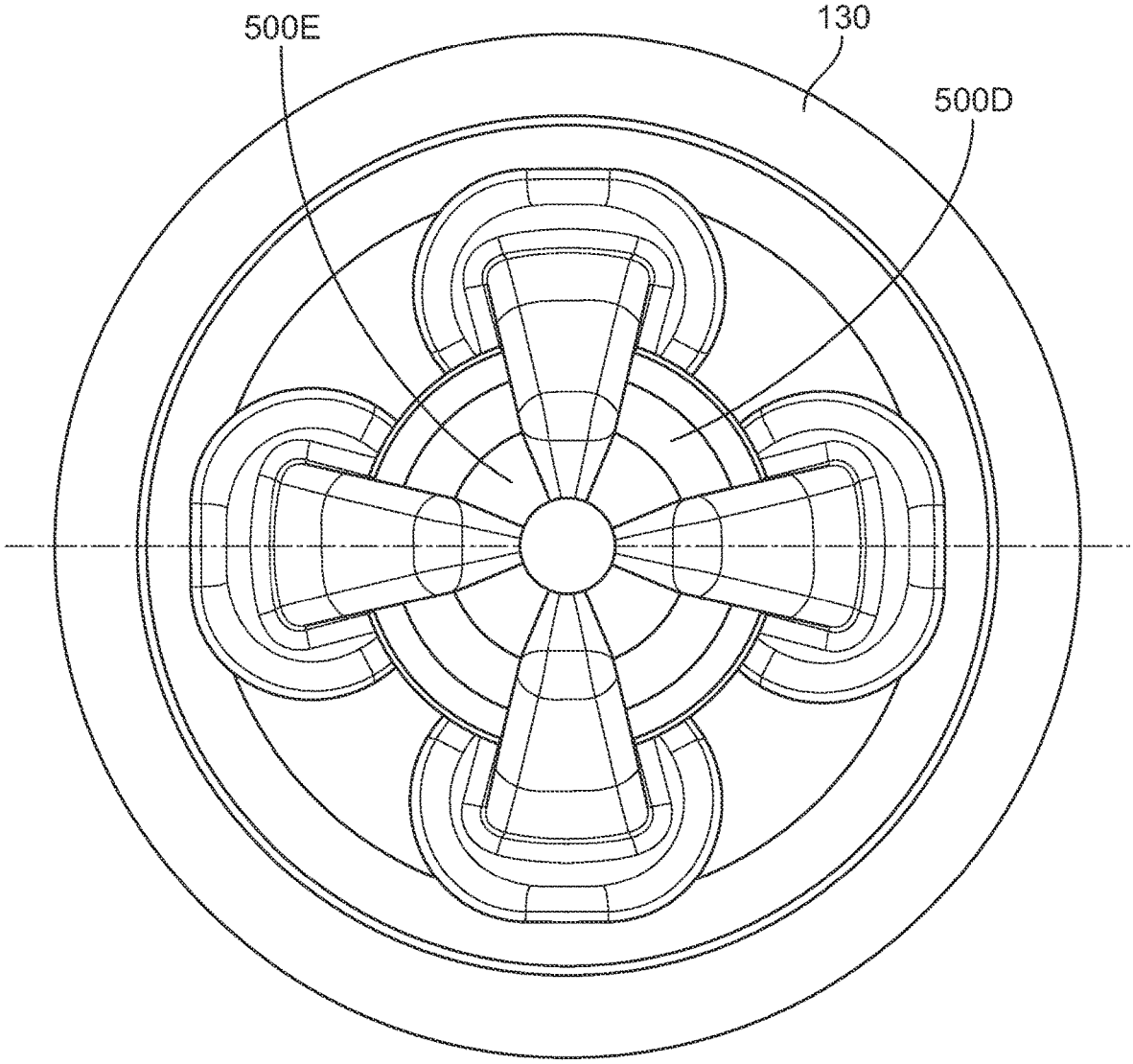
FIG. 11 is an exemplary schematic view of an embodiment of the exemplary molded support structure seen from above with the first and second side portions and the top portion of the exemplary mold apparatus of FIG. 7 removed.
Figure 12:
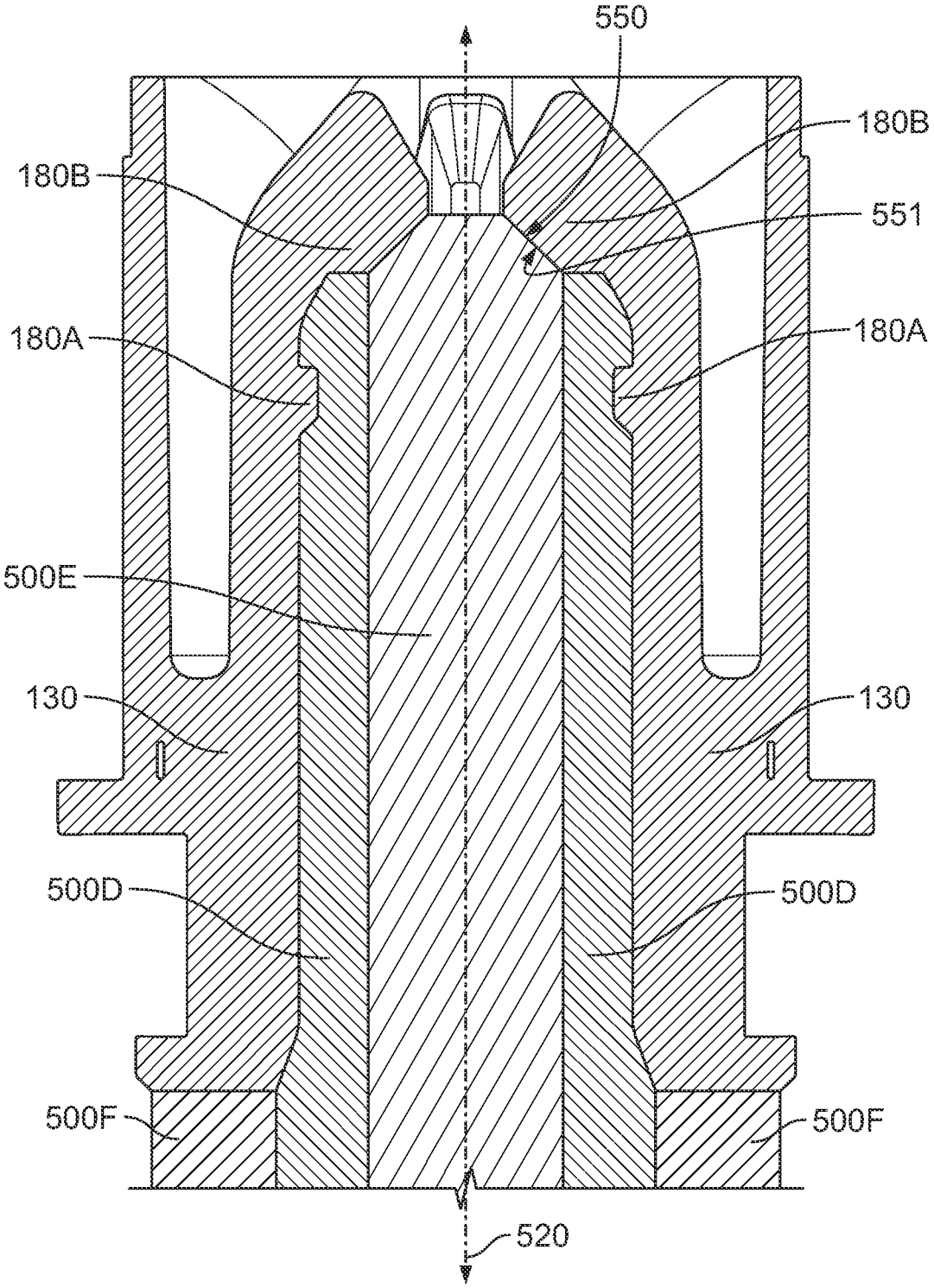
FIG. 12 is an exemplary schematic view of an embodiment of the exemplary molded support structure seen in cross-section with the first and second side portions and the top portion of the exemplary mold apparatus of FIG. 7 removed.

Referring to FIGS. 11 and 12, at this point in the exemplary method 600 the remaining components of the mold apparatus 500 are shown. Referring to FIG. 11, the molded support structure 130 is viewed as seen from above with the first and second side portions 500A and 500B and the top portion 500C removed. In this view the mold core 500D and the ejector pin 500E are clearly visible. Referring to FIG. 12, in a cross-sectional view and as noted previously, the support structure 130 is visibly locked onto the mold core 500D by the first and second hooked portions 180A, 180B. However, a top portion 550 of the ejector pin 500E makes contact with a radially interior surface 551 of each of the second hooked portions 180B. The top portion 550 and the radially interior surface 551 of each of the second hooked portions 180B are in contact along a surface that is tapered relative to the longitudinal axis 520 as shown in FIG. 12. The tapered contact surface between the top portion 550 and the radially interior surface 551 of each of the second hooked portions 180B allows for an upwardly sliding motion of the ejector pin 500E relative to the second hook portions 180B. The upwardly sliding motion of the ejector pin 500E causes a separation of the second hook portions 180B as shown in FIG. 13.

Figure 13:
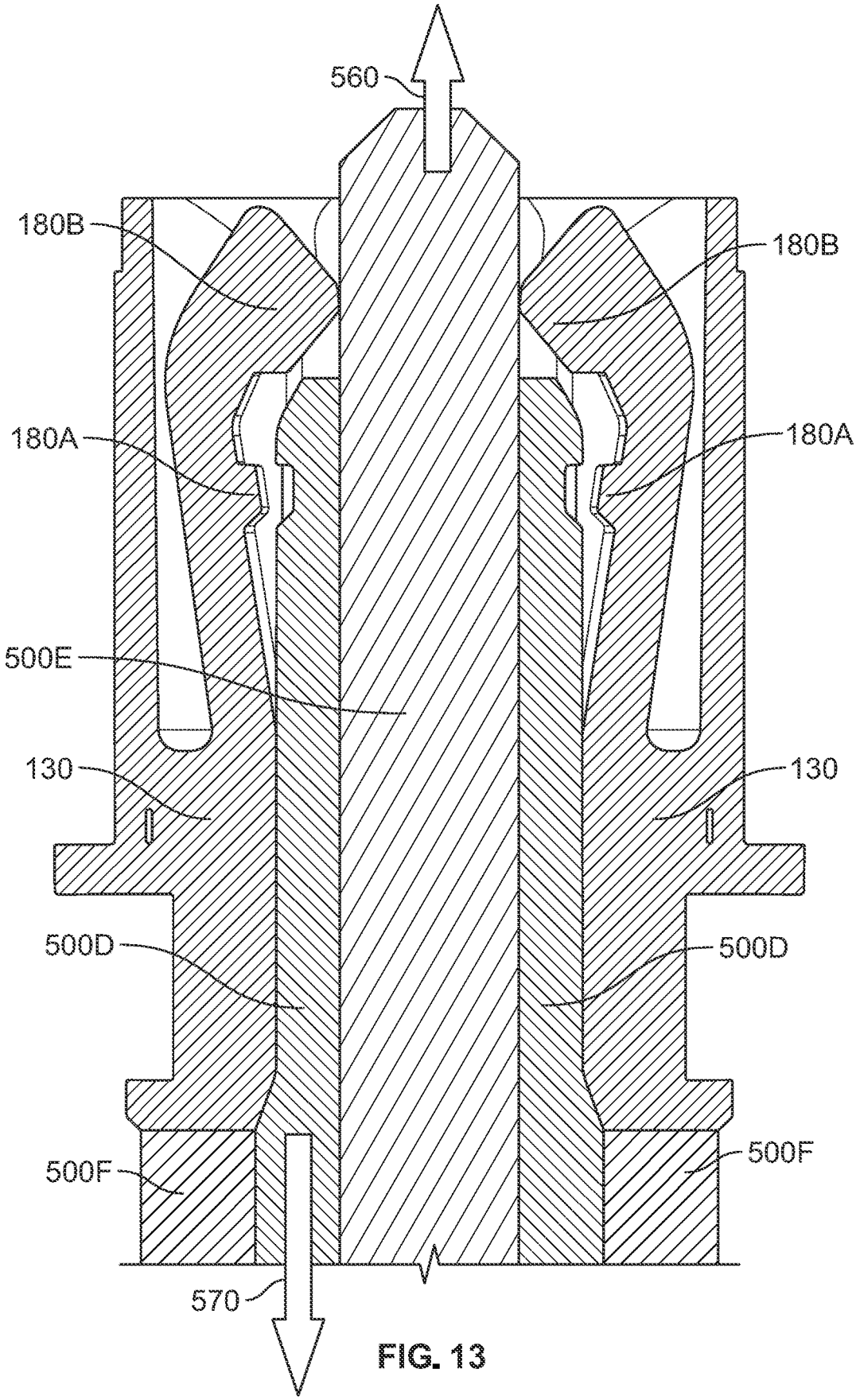
FIG. 13 is a cross-sectional schematic view of exemplary release steps in an embodiment of the method for making the support structure.

Referring to FIGS. 10 and 13, at step 614 the ejector pin 500E is moved toward the free ends of the second hooked portions 180B as indicated by arrow 560. The upward motion of the ejector pin 500E causes the second hooked portions 180B to separate sufficiently so that the first hooked portions 180A are pulled out clear from the mold core 500D as shown in FIG. 13. In an embodiment, at step 616 the mold core 500D is optionally moved away from the free ends of the second hooked portions 180B and out of the mold apparatus 500 as indicated by the arrow 570. However, removal of the mold core 500D at step 616 is optional, and in another embodiment the mold core 500D is not removed at step 616 but is rather just left in place.

At this point in the method 600 the support structure 130 remains disposed on the ejector pin 500E. Therefore, in an embodiment at step 618 the support structure 130 is pushed by the knockout plate 500F to be clear of the ejector pin 500E and also to be completely released from the mold apparatus 500. Alternatively, in an embodiment, for example, where the knockout plate 500F is fixed, at step 618 the ejector pin 500E is moved in a direction opposite to the arrow 560 so that the support structure 130 is left clear of the ejector pin 500E and completely released from the mold apparatus 500. In another embodiment, for example, where the knockout plate 500F is fixed and the mold core 500D was just left in place at step 616, then at step 618 the mold core 500D and ejector pin 500E are moved together in a direction 570 opposite to the arrow 560 so that the support structure 130 is left clear of the mold core 500D and ejector pin 500E and completely released from the mold apparatus 500.

FIGS. 14-22 illustrate additional embodiments of a mouthpiece assembly that provides a releasable mouthpiece locking mechanism. The mouthpiece assembly includes a locking adapter that can seal a cartridge reservoir and that can accept interchangeable mouthpiece shells via press fit or friction fit. The locking adapter is releasable via a radially compressive force applied to depress a pair of release arms on the locking adapter.

Figure 14:
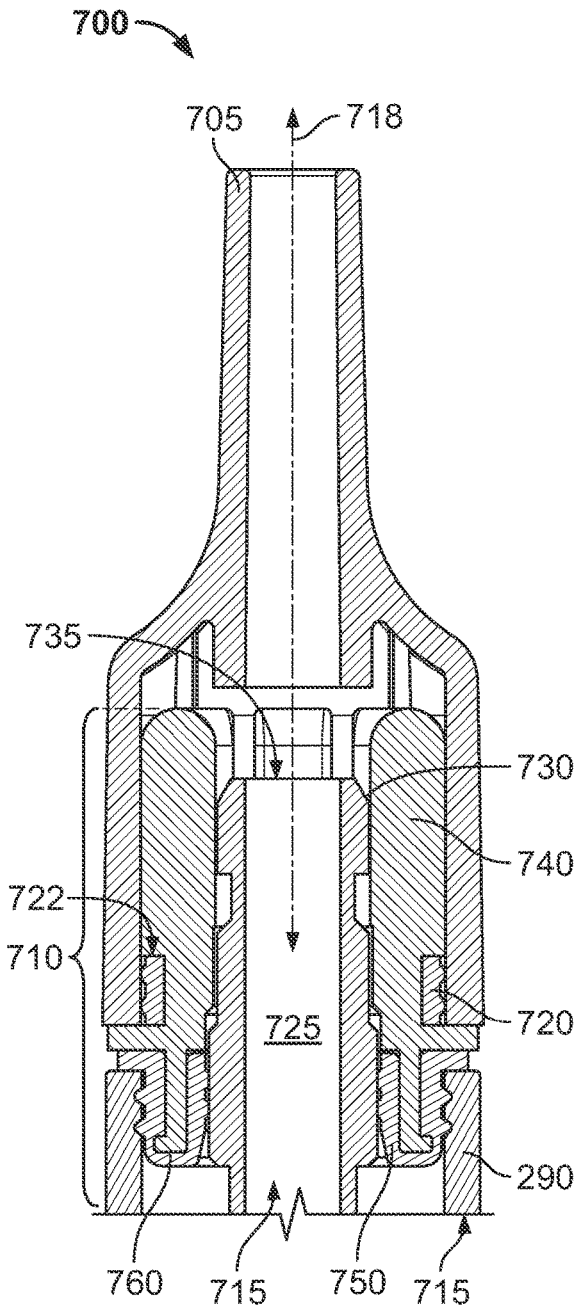
FIG. 14 illustrates a mouthpiece assembly in cross-section including a locking adapter for a releasable locking mechanism (RLM) according to another embodiment.
Figure 15:
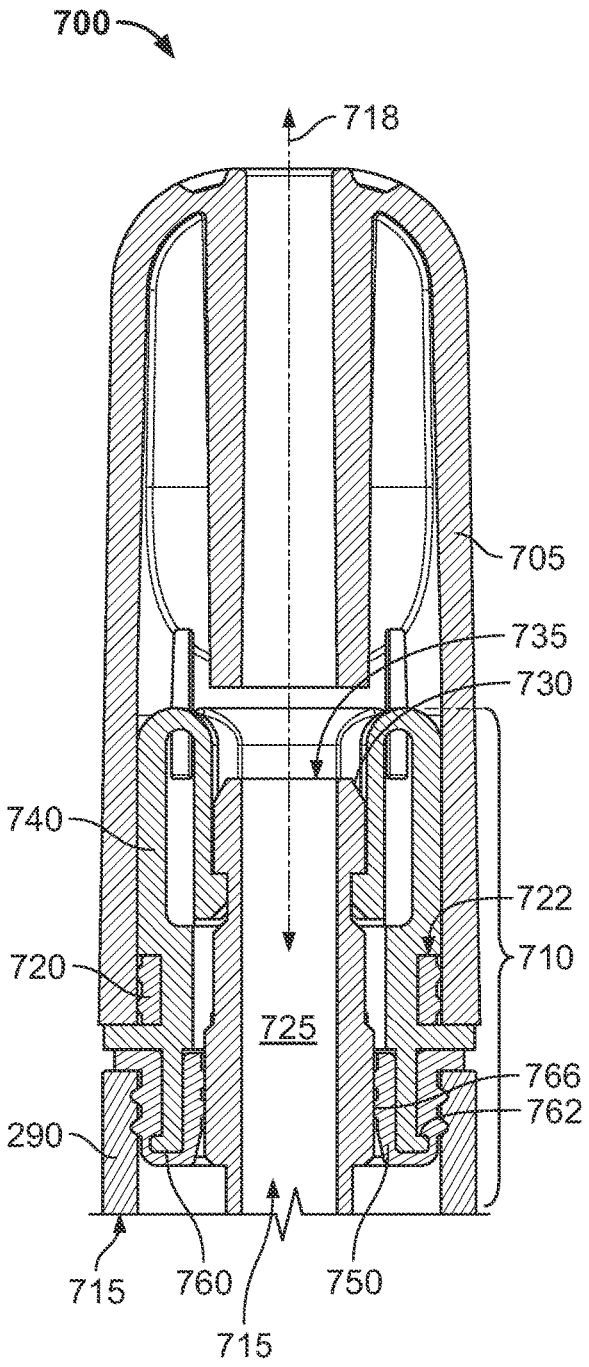
FIG. 15 illustrates the embodiment of the mouthpiece assembly of FIG. 14 in cross-section and rotated by 90 degrees relative to FIG. 14.
Figure 16:
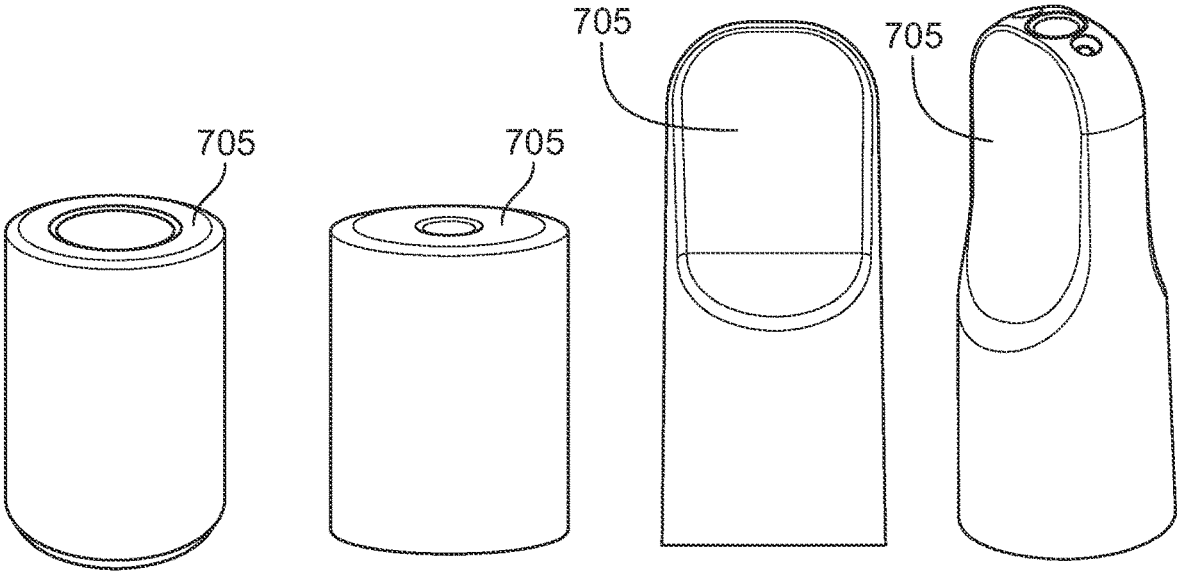
FIG. 16 illustrates several exemplary interchangeable mouthpieces according to various embodiments.

Referring now to FIGS. 14 and 15, a mouthpiece assembly 700 including a releasable locking mechanism (RLM) is shown in cross-sectional views relatively rotated by 90 degrees, respectively. In an embodiment the mouthpiece assembly 700 comprises an interchangeable mouthpiece 705 disposed over a locking adapter 710 that releasably locks onto a vaporization cartridge 715. Only a top end of the cartridge 715, comprising a tube 725 and outer wall 290, is visible in these figures; however, in an embodiment the cartridge 715 is similar to the cartridge 200 described hereinabove (see FIG. 2) and includes the tube 725 having a radially outwardly extending shoulder 530 disposed circumferentially around a first end 735 of the tube 725 (and the cartridge 715).

Referring momentarily to FIG. 2, like components of the cartridge 725 are described using the same reference numerals as used in FIG. 2. In an embodiment the cartridge 725, like the cartridge 200 in FIG. 2, further includes a connection 240, for example without limitation, a threaded connection 240 disposed at a second end 250 of the cartridge 725 (see cartridge 200 in FIG. 2). The connection 240 allows the cartridge 725 to connect to a source of power, for example a battery component (not shown) having a complementary connector, to provide power to a heating unit 260 disposed with the cartridge 725 (see cartridge 200 in FIG. 2).

Referring to FIGS. 14 and 15, the mouthpiece assembly 500 in an embodiment is illustrated with an interchangeable mouthpiece 705 attached by a friction fit, for example, by a press-fit of the interchangeable mouthpiece 705 over a sealing ring 720 as shown. In an embodiment the locking adapter 710 includes a body portion 740, and a sealing ring 720 disposed around the body portion 740. The sealing ring 720 in an embodiment is a ring of elastic compressible material, for example without limitation an O-ring, that is held within a circumferential groove 722 disposed around an outer surface of the body portion 740, for example, by elastic tension. The sealing ring 720 extends slightly radially above the groove 722 so that a frictional connection between the interchangeable mouthpiece 705 and the sealing ring 720 is sufficient to keep the interchangeable mouthpiece 705 attached for use, while also allowing the interchangeable mouthpiece 705 to be slid off of the sealing ring 720 just by pulling the interchangeable mouthpiece 705 longitudinally (upwardly in FIGS. 14 and 15 along a longitudinal axis 718) relative to the sealing ring 720.

The interchangeable aspect of the mouthpiece 705 allows for a variety of different mouthpieces 705 (see FIG. 16) to be used, for example, having different shapes and aperture sizes to be interchanged as needed or desired by a user. In an embodiment, the interchangeable mouthpiece 705 is made of a rigid material that is resistant to a radially compressive force applied to an outer circumferential surface of the interchangeable mouthpiece 705. In another embodiment, the interchangeable mouthpiece 705 is made of an elastically flexible material that elastically flexes inwardly in response to a radially compressive force applied to an outer circumferential surface of the interchangeable mouthpiece 705. As is further described hereinbelow, embodiments of the mouthpiece assembly 700 including an elastically flexible interchangeable mouthpiece 705 are releasable without removing the mouthpiece 705 from the interlocking adapter 710.

Referring again to FIGS. 14 and 15, in an embodiment the body portion 740 further comprises a sealing cap ring 750 disposed over an inwardly facing end 760 of the body portion 740. The sealing cap ring 750 in an embodiment is a ring of elastic compressible material. In an embodiment the inwardly facing end 760 includes a radially outwardly facing shoulder 762 that inhibits the sealing cap ring 750 from coming off. In an embodiment the sealing cap ring 750 is sized to have a radial annular width that is greater than the distance between the inner surface of the outer wall 290 and an outer surface of the tube 725. In an embodiment when the locking adapter 740 is releasably locked onto the tube 725 as is described fully hereinbelow, the sealing cap ring 750 compresses to form a seal between the inner surface of the outer wall 290 and the outer surface of the tube 725.

As visible in FIGS. 14 and 15, in an embodiment the tube 725 can engage one or more ribs 766 extending radially inwardly from the sealing cap ring 750. In other embodiments the sealing cap ring 750 lacks the ribs 766.

Figure 17:
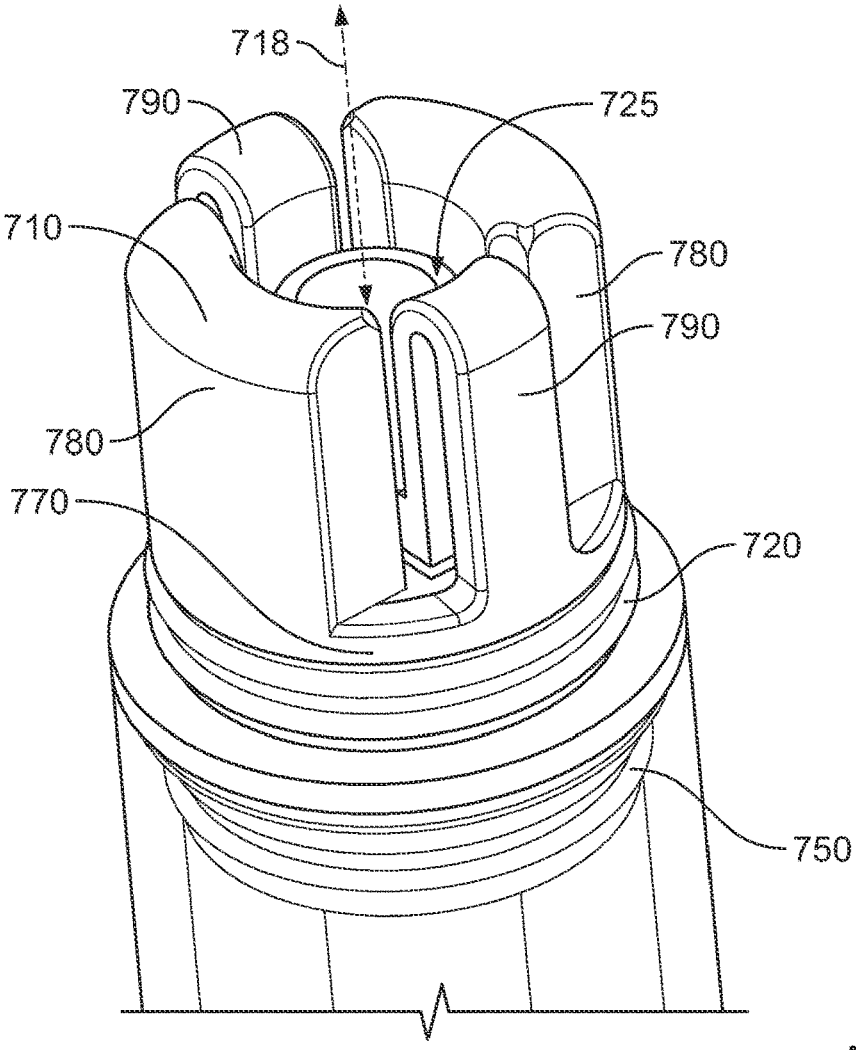
FIG. 17 illustrates an exemplary locking adapter without an interchangeable mouthpiece press fit thereover according to an embodiment.
Figure 18:
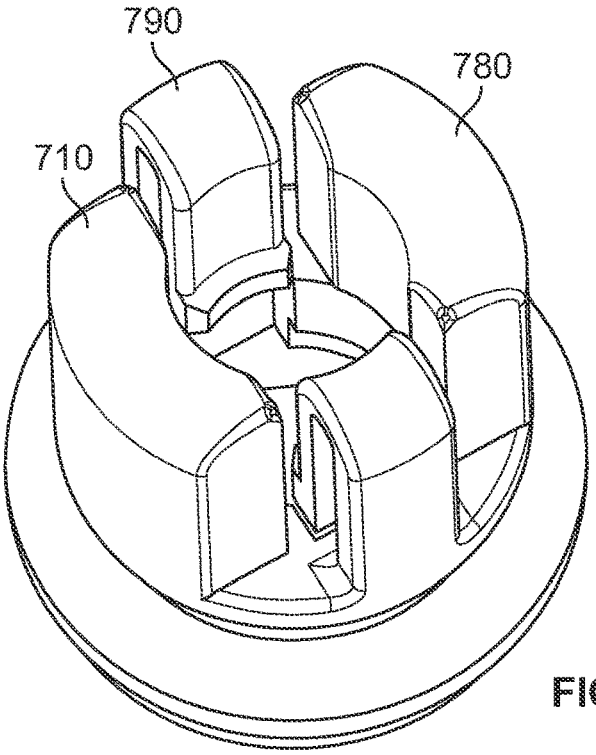
FIG. 18 illustrates a first perspective view of the exemplary locking adapter of FIG. 17.
Figure 19:
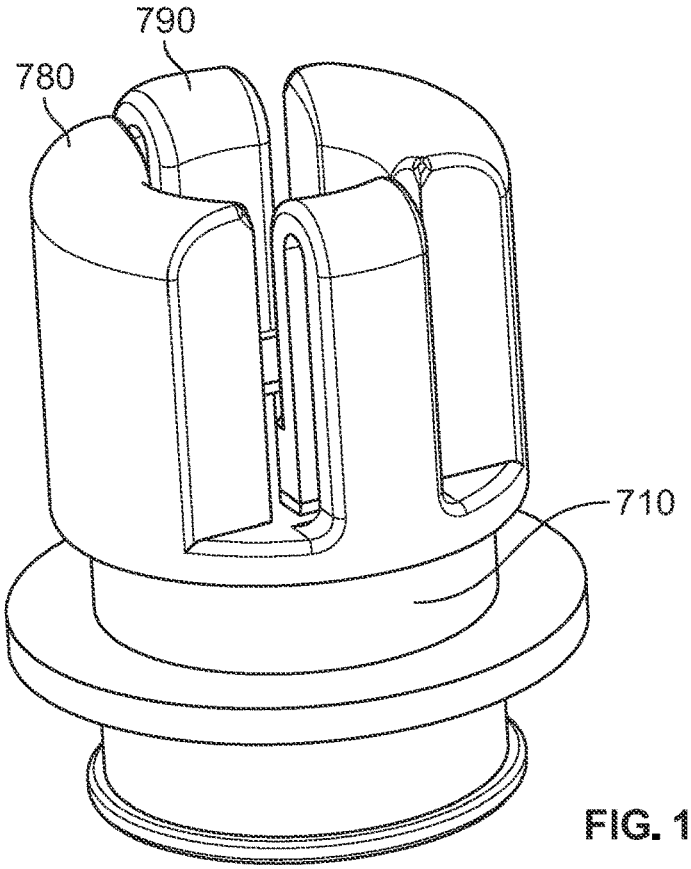
FIG. 19 illustrates a second perspective view of the exemplary locking adapter of FIG. 17.

Referring to FIG. 17, an embodiment of the locking adapter 710 is illustrated in perspective view releasably attached on the tube 725 with the interchangeable mouthpiece 705 removed. The locking adapter 710 includes a base portion 770 that supports the sealing ring 720. Immobile walls 780 and opposed release arms 790 extend longitudinally from the base portion 770. Although two immobile walls 780 are shown, there can be more than two immobile walls 780 distributed circumferentially in the spaces between the opposed release arms 790. FIGS. 18 and 19 illustrate two additional perspective views of the locking adapter 710, both showing the immobile walls 780 and the opposed release arms 790.

Figure 20:
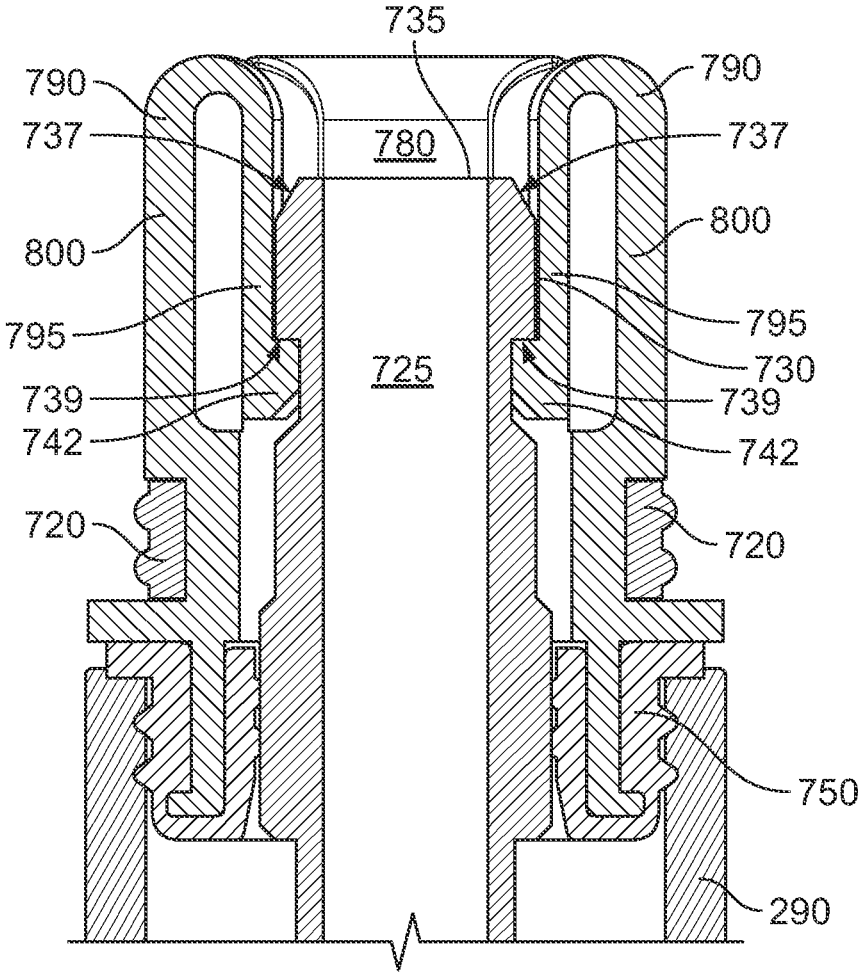
FIG. 20 illustrates an exemplary locking adapter in a locked configuration in a cross-sectional view taken through opposed release arms according to an embodiment.
Figure 21:
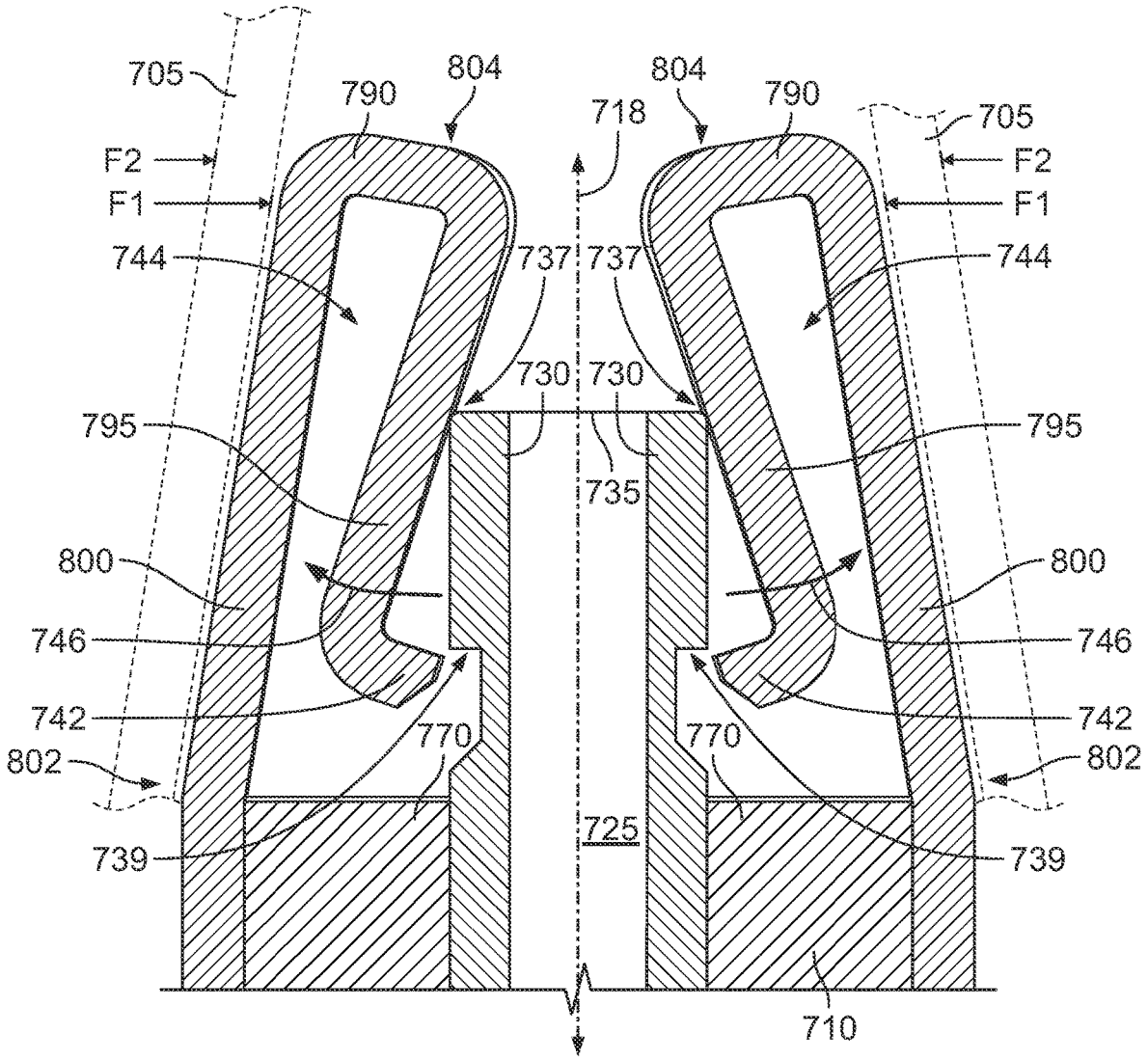
FIG. 21 illustrates an exemplary locking adapter in a released configuration in a schematic cross-sectional view taken through opposed release arms according to an embodiment.

Referring now to FIG. 20, in an embodiment the locking adapter 710 is shown in a cross-sectional view taken through the opposed release arms 790. In an embodiment each release arm 790 includes an inner portion 795 and an outer portion 800. Referring to FIG. 21, in an embodiment, the opposed release arms 790 including both the inner portions 795 and the outer portions 800 are elastically flexible at least at opposite longitudinal ends of each of the inner and outer portions 795, 800 so that each of the inner and outer portions 795, 800 can elastically flex or bend in a radial direction in response to applied force. For example, the outer portions 800 are elastically flexible at least at ends 802 where each outer portion 800 attaches to the base portion 770. Similarly, the inner portions 795 are elastically flexible at least at ends 804 from which each inner portion 795 extends.

In an embodiment the radially outwardly extending shoulder 730 at the first end 735 of the tube 725 includes a truncated or angled corner 737 proximate to the first end 735. In an embodiment the radially outwardly extending shoulder 730 also includes a generally perpendicular overhang 739 on a longitudinal end of the radially outwardly extending shoulder 730 opposite the truncated or angled corner 737. Each of the inner portions 795 includes a radially inwardly directed hook 742 on a free end thereof.

FIG. 20 illustrates the locking adapter 710 disposed on the tube 725 in a releasably attached state, wherein the hooks 742 engage longitudinally with the generally perpendicular overhangs 739 to prevent the locking adapter 710 from being removed from the tube 725. FIG. 21 further schematically illustrates a portion of the locking adapter 710 including the release arms 790 shown in a released position relative to the tube 725.

Referring to FIG. 21, in an embodiment, the locking adapter 710 is released when a radially compressive force, for example without limitation as applied between a finger and thumb of a user, is applied to outer sides of the release arms 790 as shown in FIG. 21. Depending on the type of interchangeable mouthpiece 705, the radially compressive force can be applied with the mouthpiece 705 removed or with the mouthpiece 705 in place on the locking adapter 710. A portion of an elastically flexible interchangeable mouthpiece 705 is indicated in dashed lines in FIG. 21 to illustrate this point. In an embodiment wherein the mouthpiece assembly 700 includes a rigid interchangeable mouthpiece 705, a radially compressive force is applied at F1 to opposite sides of the release arms 790 as shown after removal of the interchangeable mouthpiece 705. In an embodiment wherein the mouthpiece assembly 700 includes an elastically flexible interchangeable mouthpiece 705, a radially compressive force is applied with the interchangeable mouthpiece 705 in place on the locking adapter 710 at F2 to opposite outside surfaces of the interchangeable mouthpiece 705 directed over opposite sides of the release arms 790 as shown.

In an embodiment the outer portions 800 of the release arms 790 elastically flex inwardly in response to the radially compressive force, F1 or F2, as indicated by arrows 744. As a result of this elastic flexing, in an embodiment the radially innermost edges of the top ends of the release arms 790 are pushed toward the longitudinal axis 718 such that the radially innermost edges of the top ends of the release arms 790 are radially inward of the truncated or angled corners 737. In response, in an embodiment each inner portion 795 effectively elastically pivots on the truncated or angled corners 737 and elastically flexes outwardly away from the longitudinal axis 718, as indicated by arrows 746. In an embodiment the outward elastic flexing of the inner portions 795 effectively pulls the hooks 742 away from the tube 725 and out of longitudinal engagement with the generally perpendicular overhangs 739. Thus, in the position shown in FIG. 21, the releasable locking adapter 710 in an embodiment is released from the tube 725 and can be pulled off the tube 725 by being pulled longitudinally (upward in FIG. 21) relative to the tube 725.

Figure 22:
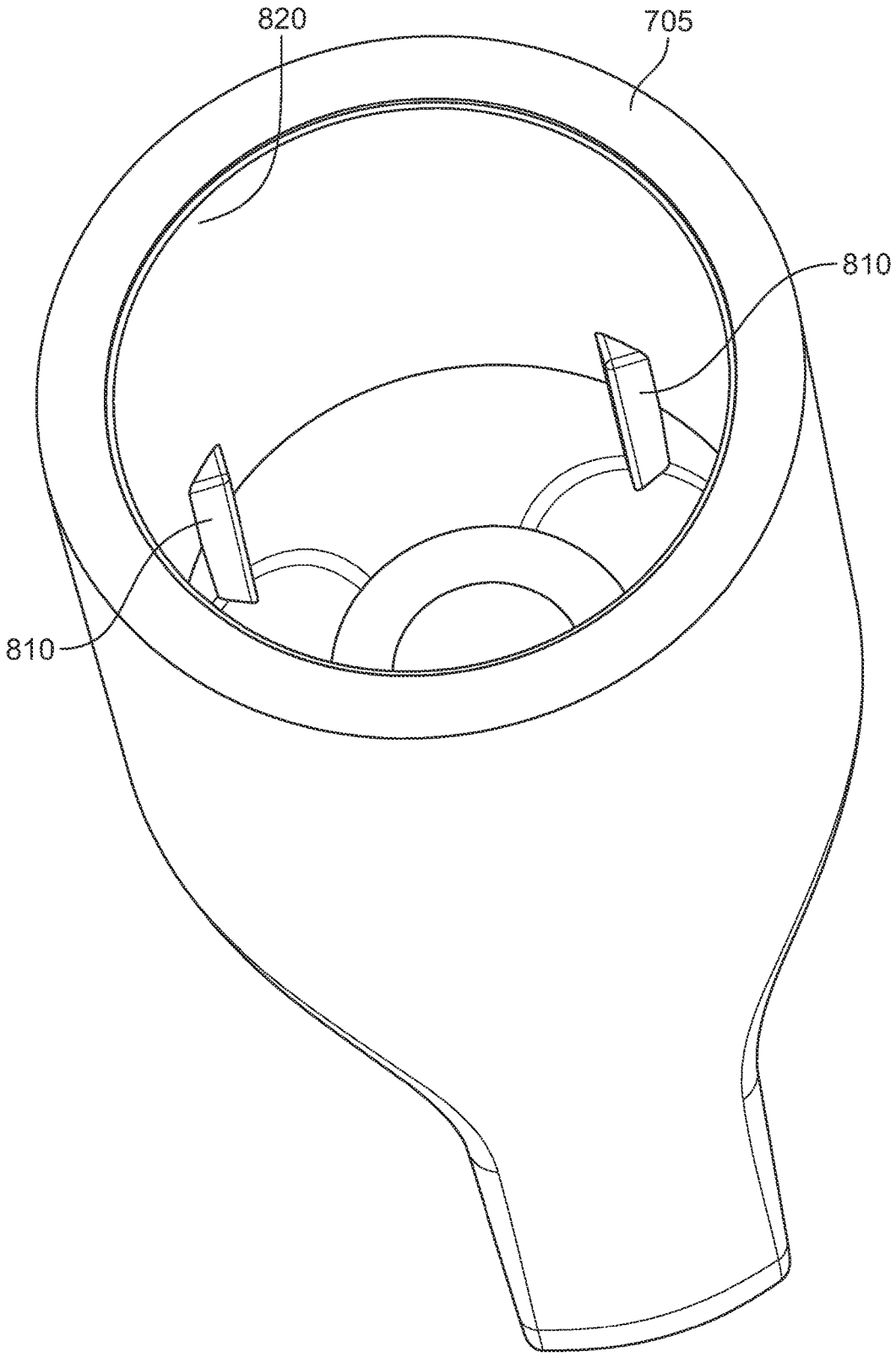
FIG. 22 illustrates one or more ribs that extend generally vertically along an interior surface of an interchangeable mouthpiece according to an embodiment.

Referring now to FIG. 22, in an embodiment an interior portion of an interchangeable mouthpiece 705 is illustrated. In an embodiment one or more ribs 810 extend generally vertically along an interior surface 820 of the interchangeable mouthpiece 705. The one or more ribs 810 can be present on either of the elastically flexible or rigid types of interchangeable mouthpiece 705. The one or more ribs 810 inhibit wiggling of the interchangeable mouthpiece 705 by providing a tighter fit or tolerance, for example, between the interior surface 820 and outer surfaces of the locking adapter 710, when the interchangeable mouthpiece 705 is press fit over the locking adapter 710.

In an embodiment, the mouthpiece assembly 700 including the interchangeable mouthpiece housing 705, the releasably locking adapter 710 and all the components associated therewith as described hereinabove are made, for example without limitation, by plastic injection using a mold. In an embodiment the mouthpiece assembly 700 including the interchangeable mouthpiece 705, the releasably locking adapter 710 and all the components associated therewith as described hereinabove are made from a plastic, for example without limitation, Polycarbonate (PC), Poly Cyclohexylenedimethylene Terephthalate Glycol (PCTG), Polyamide Nylon (PA), Polypropylene (PP), and other various plastic as known in the art.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

What is claimed is:

1. A releasably locking mouthpiece 100 having a first end and an opposed second end disposed along a longitudinal axis 300, the mouthpiece comprising:

a support structure 130 having a passage 170 extending along the longitudinal axis;

one or more pairs of opposed first and second arms 180 extending longitudinally from the support structure towards the first end of the mouthpiece, each of the first and second arms comprising a first hooked portion 180A and a second hooked portion 180B extending radially inwardly toward the longitudinal axis, the first and second arms being radially flexible;

each of the first hooked portions 180A comprising a surface 182 that is tapered away from the second end of the mouthpiece and toward the longitudinal axis 300 of the mouthpiece;

each of the second hooked portions 180B including a first side facing toward the first end of the mouthpiece 100, the first side having a surface 186 that is angled relative to the longitudinal axis 300 of the mouthpiece 100.

2. The mouthpiece of claim 1, wherein the one or more pairs of opposed first and second arms are disposed for accommodating therebetween a radially extending portion of a tube of a vaporization cartridge 200 that is aligned with the passage along the longitudinal axis, wherein the mouthpiece releasably locks with the vaporization cartridge.

3. The mouthpiece of claim 2, further comprising: a sealing cap ring 140 disposed at the second end of the mouthpiece, the sealing ring being supported by the support structure.

4. The mouthpiece of claim 1, further comprising:

a mouthpiece housing 150 having a passage 110 disposed therethrough, the passage extending along the longitudinal axis 300 and including a hole 120 disposed at the first end of the mouthpiece 100;

wherein the support structure is disposed within the mouthpiece housing and extends from the mouthpiece housing at the second end of the mouthpiece;

and wherein the passage of the support structure is longitudinally aligned with and in fluid communication with the passage of the mouthpiece housing.

5. The mouthpiece of claim 1, wherein:

(a) the support structure is made of a flexible material;

(b) the one or more pairs of first and second arms are integrally formed with the support structure;

(c) one or more pairs of first and second arms comprise first and second pairs of first and second arms, the first and second arms of each of the first and second pairs being diametrically opposed to one another; and (d) each of the first hooked portions 180A comprises:

a first side facing toward the second end 108 of the mouthpiece 100, the first side having the surface 182 that is tapered relative to the longitudinal axis 300 of the mouthpiece 100; and a second side facing away from the second end 108 of the mouthpiece 100, the second side having a surface 184 that is perpendicular to the longitudinal axis 300 of the mouthpiece 100.

6. The mouthpiece of claim 4, wherein the support structure is fixed to the mouthpiece housing.

7. The mouthpiece of claim 6, wherein the support structure is fixed to the mouthpiece mouthpiece housing via a snap fit, an ultrasonic weld, or an adhesive 160.

8. The mouthpiece of claim 4, wherein the support structure is not fixed to the mouthpiece housing.

9. The mouthpiece of claim 5, wherein for each pair of first and second arms the second hooked portions 180B are separated by a distance D2.

10. The mouthpiece of claim 5, comprising displacing the opposing second hooked portions 180B radially away from the longitudinal axis 300 so that the second hooked portions 180B are separated by a distance greater than D2 displaces the opposing first hooked portions 180A away from the longitudinal axis 300 so that the opposing first hooked portions 180A are separated by a separation distance D1 that is greater than a distance D3 between radially outer surfaces of a tube of a vaporization cartridge to release the mouthpiece from the vaporization cartridge.

11. The mouthpiece of claim 5, wherein the mouthpiece further comprises a longitudinally extending pin 400 having a cross-sectional dimension Dp that is larger than the distance D2 between the second hooked portions 180B, wherein insertion of the longitudinally extending pin from the first end of the mouthpiece 100 displaces the opposing second hooked portions 180B radially away from the longitudinal axis 300 so that the second hooked portions 180B are separated by a distance greater than D2.

12. The mouthpiece of claim 11, wherein the longitudinally extending pin has a circular cross-section in shape having a diameter that is equal to the cross-sectional dimension.

* * * * *